US010767953B2

(12) United States Patent
Cole

(10) Patent No.: US 10,767,953 B2
(45) Date of Patent: Sep. 8, 2020

(54) AUTOMATIC VARIABLE CHOKE PUNT GUN FOR SWARM DEFENSE

(71) Applicant: Tony Mitchell Cole, Enterprise, FL (US)

(72) Inventor: Tony Mitchell Cole, Enterprise, FL (US)

( * ) Notice: Subject to any disclaimer, the term of this patent is extended or adjusted under 35 U.S.C. 154(b) by 78 days.

(21) Appl. No.: 16/004,467

(22) Filed: Jun. 11, 2018

(65) Prior Publication Data

US 2019/0376759 A1 Dec. 12, 2019

(51) Int. Cl.
*F41A 21/40* (2006.01)
*F41A 21/42* (2006.01)

(52) U.S. Cl.
CPC ..... *F41A 21/40* (2013.01); *F41A 21/42* (2013.01)

(58) Field of Classification Search
CPC ..... F41A 21/40; F41A 21/42
USPC ..... 42/79
See application file for complete search history.

(56) References Cited

U.S. PATENT DOCUMENTS 2,765,564 A * 10/1956 Schroeder ..... F41A 21/40 42/79
2,807,903 A * 10/1957 Wheeler ..... F41A 21/42 42/79
2019/0178613 A1* 6/2019 Zaetterqvist ..... B64D 7/00

FOREIGN PATENT DOCUMENTS

CH 240479 * 4/1946
WO WO-2017200458 A1 * 11/2017 ..... F42B 5/15

* cited by examiner

*Primary Examiner* — Stephen Johnson

(57) ABSTRACT

A system includes a variable choke coupled to a barrel of a shot gun, and a mechanical mechanism coupled to the variable choke and configured to adjust an amount of choke constriction of the variable choke. The system further includes a motor coupled to the mechanical mechanism, and a control system configured to determine a desired size of a shot cone of shot fired from the shot gun, determine a choke constriction position of the variable choke that produces the identified size of the shot cone, and apply control signals to the motor to cause, via movement of the mechanical mechanism, automatic adjustment of the variable choke based on the determined choke constriction position of the variable choke.

19 Claims, 25 Drawing Sheets

AUTOMATIC VARIABLE CHOKE PUNT GUN FOR SWARM DEFENSE

BACKGROUND

Punt guns are extremely large shotguns that were used in the nineteenth and early twentieth centuries for shooting large numbers of waterfowl during commercial harvesting operations (also called "market hunting"). Punt guns have barrel bore diameters that typically are two inches or greater, and usually fire over a pound of shot at a time. Punt guns were often several feet in length, and weighed a great deal (e.g., 75 pounds or greater) relative to conventional shotguns. Since punt guns were so large, and their recoil was so great, the guns were usually mounted directly on "punt" boats, which is where their name originated. Punt boats were long, flat-bottomed boats that were designed for use in small rivers or other shallow water, and typically were propelled with a long pole. In the U.S., the practice of using punt guns through the 1800s dramatically depleted the stocks of wild waterfowl, and by the 1860s most states had banned their use for waterfowl hunting. A series of federal laws banned the practice of market hunting in the early 1900s.

DETAILED DESCRIPTION OF THE PREFERRED EMBODIMENTS

The following detailed description refers to the accompanying drawings. The same reference numbers in different drawings may identify the same or similar elements. The following detailed description does not limit the invention, which is defined by the claims.

Figure 1:
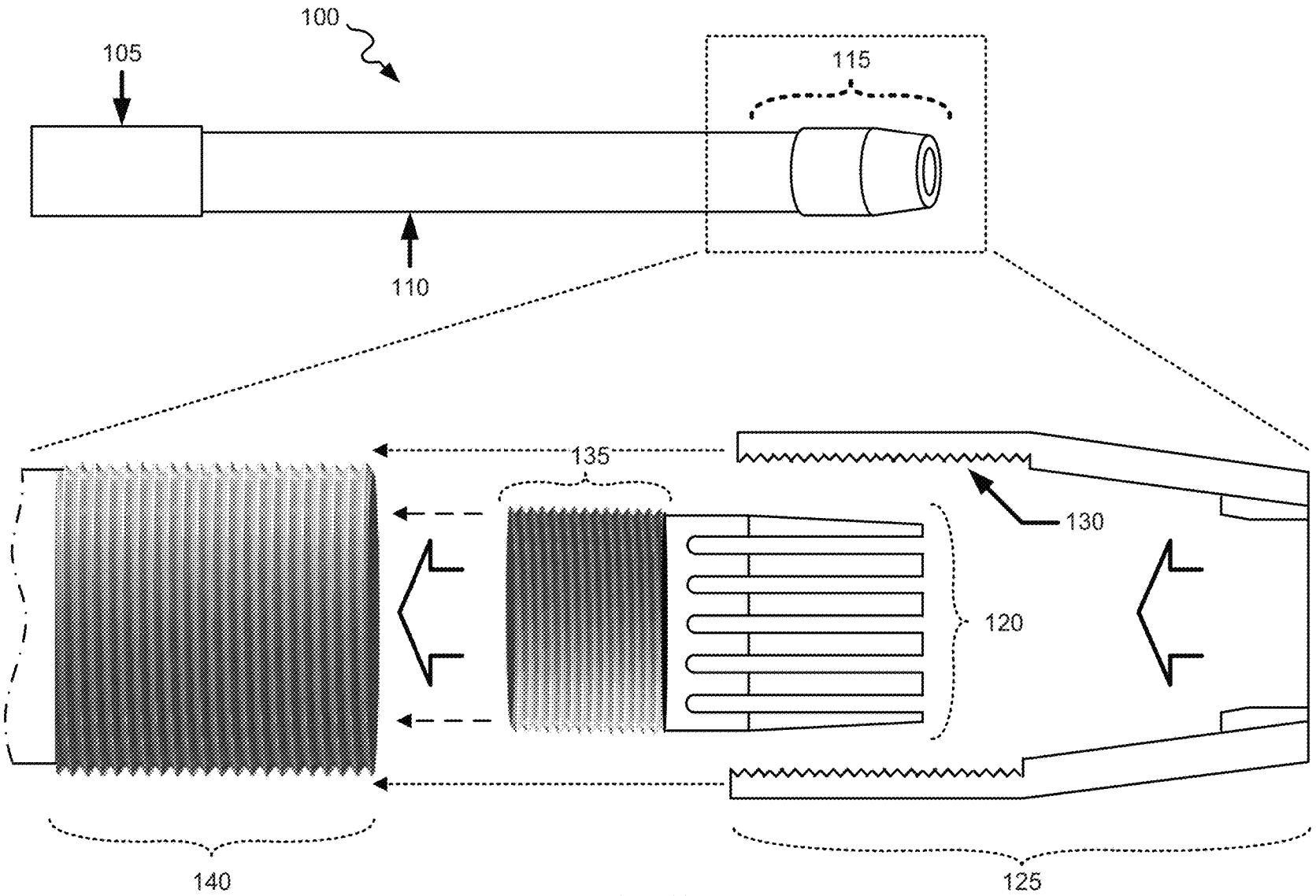
FIG. 1 illustrates basic components of an exemplary automatic variable choke punt gun.

FIG. 1 illustrates basic components of an exemplary automatic variable choke punt gun 100. As shown, variable choke punt gun 100 includes an action 105, a barrel 110, and a variable choke mechanism 115. The action 105 includes the components, contained within a housing, that load, chamber, fire, extract, and eject shot shells. Various different types of existing semi-automatic or automatic actions may be used within punt gun 100 that permit a control system (described in further detail below) to cause punt gun shells to be loaded, fired, and re-loaded. The barrel 110 includes a shotgun barrel having a bore of an appropriate diameter for firing punt gun-sized shells. Barrel 110, in some implementations, may have a bore diameter of two inches or greater. Additionally, barrel 110, in some implementations, may have a length of several feet or greater. The variable choke mechanism 115 includes any type of mechanism that permits mechanical adjustment of an amount of constriction (or "choke") applied to shot balls traveling from action 105 and exiting the muzzle of barrel 110 so as to control the spread pattern of the fired shot balls.

The lower portion of FIG. 1 depicts further details of one exemplary implementation of variable choke mechanism 115 of punt gun 100. As shown, variable choke mechanism 115 may include an inner choke sleeve 120, and an outer choke sleeve 125 which, when attached at the muzzle of barrel 110, can be adjusted by an external control system (not shown) to control the amount of choke constriction applied to shot balls fired from action 105 through barrel 110. Inner choke sleeve 120 may include an exterior male thread pattern 135 that threads into an interior female thread pattern (not shown) within the muzzle end of barrel 110 of punt gun 100. Inner choke sleeve 120, in the exemplary implementation shown in FIG. 1, may be threaded into the muzzle end of barrel 110 until none of thread pattern 135 extends beyond the muzzle of barrel 110.

Inner choke sleeve 120 includes a tubular material that further includes the exterior male thread pattern 135 disposed at one end of inner choke sleeve 120, and multiple elongated constriction fingers 120 disposed at an opposite end of inner choke sleeve 120. The material of inner choke sleeve 120 may include any material that is sufficiently hard and durable to withstand the forces associated with channeling fired shot balls out of the muzzle of barrel 110, but which also has sufficient flexibility such that outer choke sleeve 125, when threaded onto barrel 110, causes the multiple elongated constriction fingers 120 to flex inwards, imparting choke constriction to fired shot balls. The material of inner choke sleeve 120 may include, for example, a metal (e.g., steel, ballistic aluminum), a metal alloy, or a composite material (e.g., ballistic aluminum infused with ceramic). The elongated constriction fingers of inner choke sleeve 120 are spaced evenly around the muzzle end of inner choke sleeve 120, with a sufficient gap between each elongated constriction finger to permit a desired amount of flexing and choke constriction, but having a maximum gap between each constriction finger that prevents fired shot balls, channeled through inner choke sleeve 120, from entering the gaps between the constriction fingers.

Outer choke sleeve 125 includes an interior female thread pattern 130 that threads onto an exterior male thread pattern 140 located at the muzzle end, on the exterior surface, of barrel 110. As described further below, outer choke sleeve 125 may be threaded onto, or off of, the male thread pattern 140 at the muzzle of barrel 110 to increase or decrease the amount of choke constriction applied to inner choke sleeve 120. Outer choke sleeve 125 may include, for example, a metal, a metal alloy, or a composite material that may be a same material, or a different material, than the material of which inner choke sleeve 120 is composed.

Figure 2A:
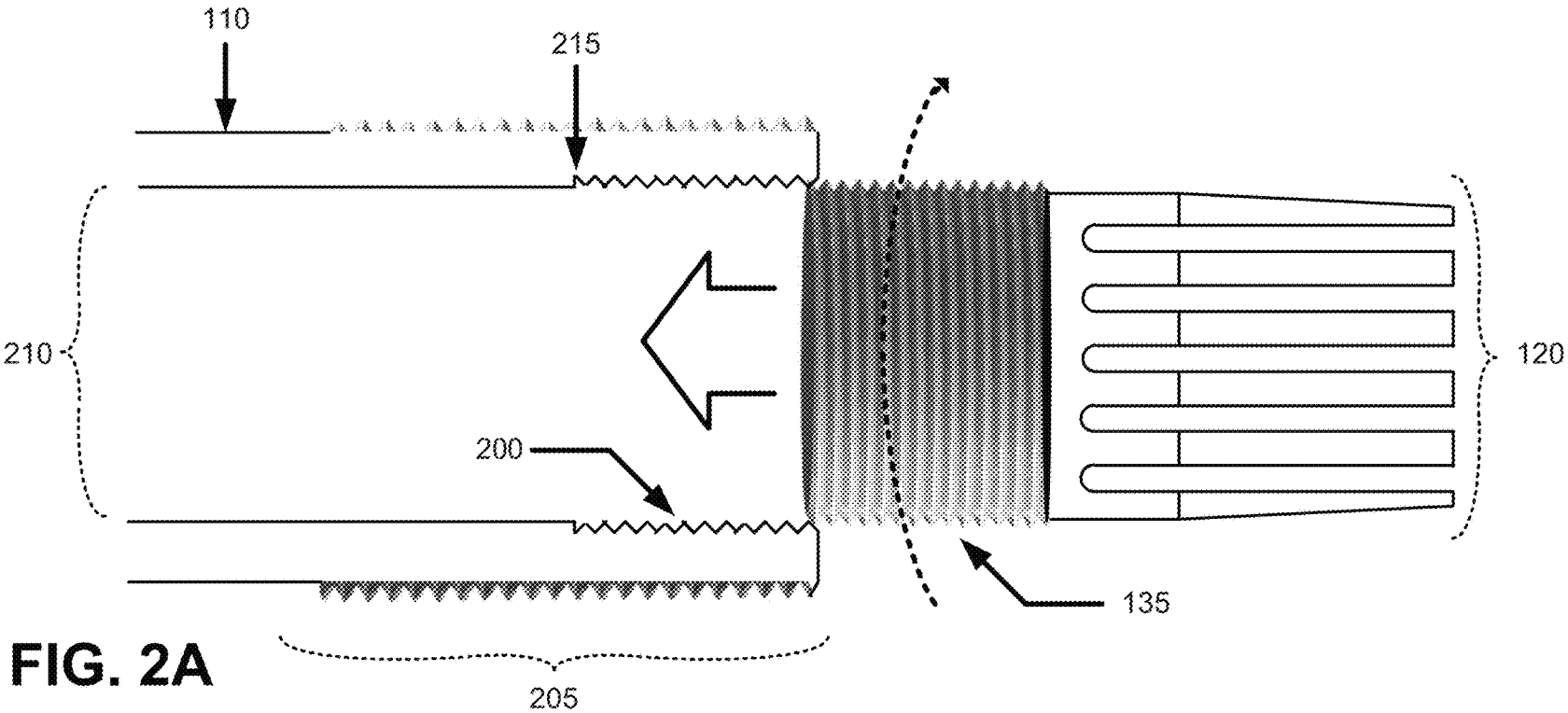
FIGS. 2A and 2B depict details of the threading of the inner choke sleeve of the variable choke punt gun of FIG. 1 into the punt gun barrel.
Figure 2B:
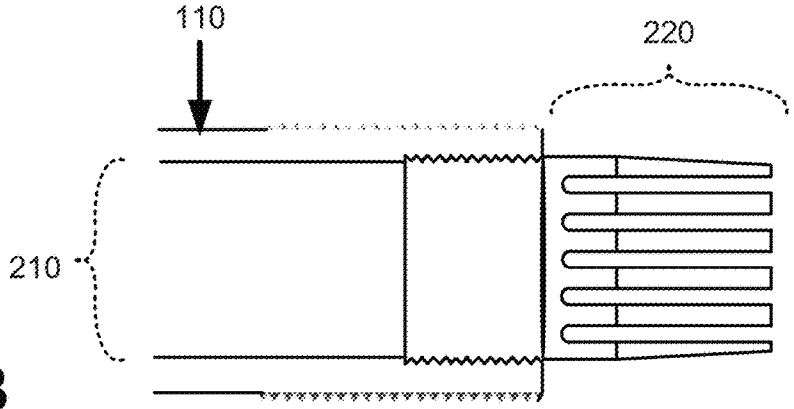

FIG. 2A depicts close-up detail of the threading of inner choke sleeve 120 into barrel 110. As shown, exterior male threads 135 of inner choke sleeve 120 may be threaded, by rotating inner choke sleeve 120, into female interior threads 200 located at the muzzle end 205 of barrel 110 on the internal surface of bore 210 of barrel 110. Inner choke sleeve 120 can be threaded into the female interior threads 200 of barrel 110 until inner choke sleeve 120 reaches a choke sleeve stop position 215. The direction of rotation of inner choke sleeve 120 to thread sleeve 120 into barrel 110 depends on whether exterior male threads 135 and interior female threads 200 have a right-handed or a left-handed thread pattern. Either right-handed or left-handed thread patterns may be used within variable choke mechanism 115. FIG. 2B depicts inner choke sleeve 120 completely threaded into the muzzle end 205 of barrel 110, to the choke sleeve stop position 215, such that only elongated constriction fingers 220 of inner choke sleeve 120 extend from the bore 210 of barrel 110. The elongated constriction fingers 220 of inner choke sleeve 120 provide the constriction of the outgoing shot ball pattern, as described in further detail below.

Figure 3A:
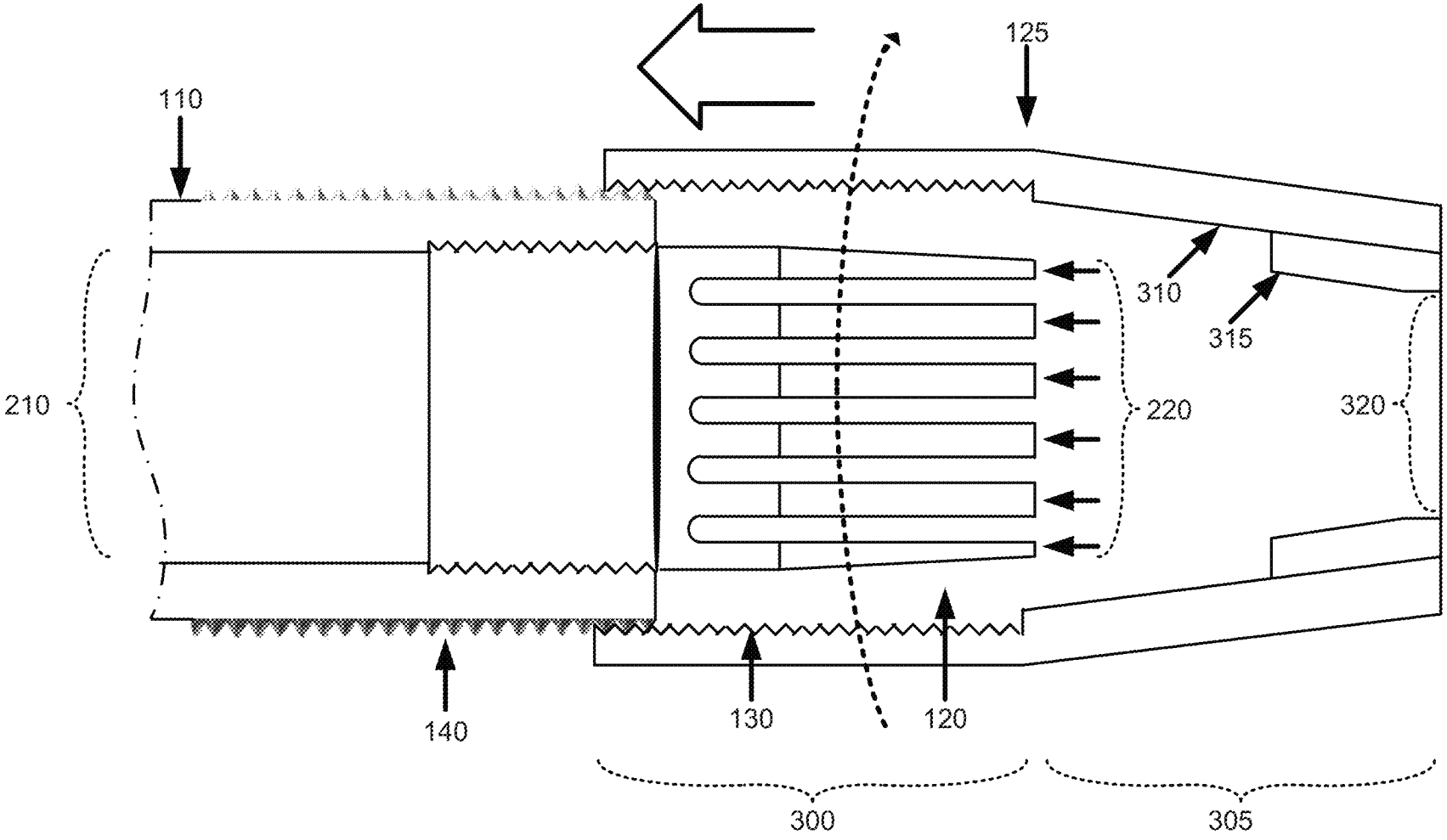
FIGS. 3A-3C depict an example of the threading of interior threads of the outer choke sleeve of the variable choke of the punt gun of FIG. 1 onto exterior threads of the punt gun's barrel.
Figure 3B:
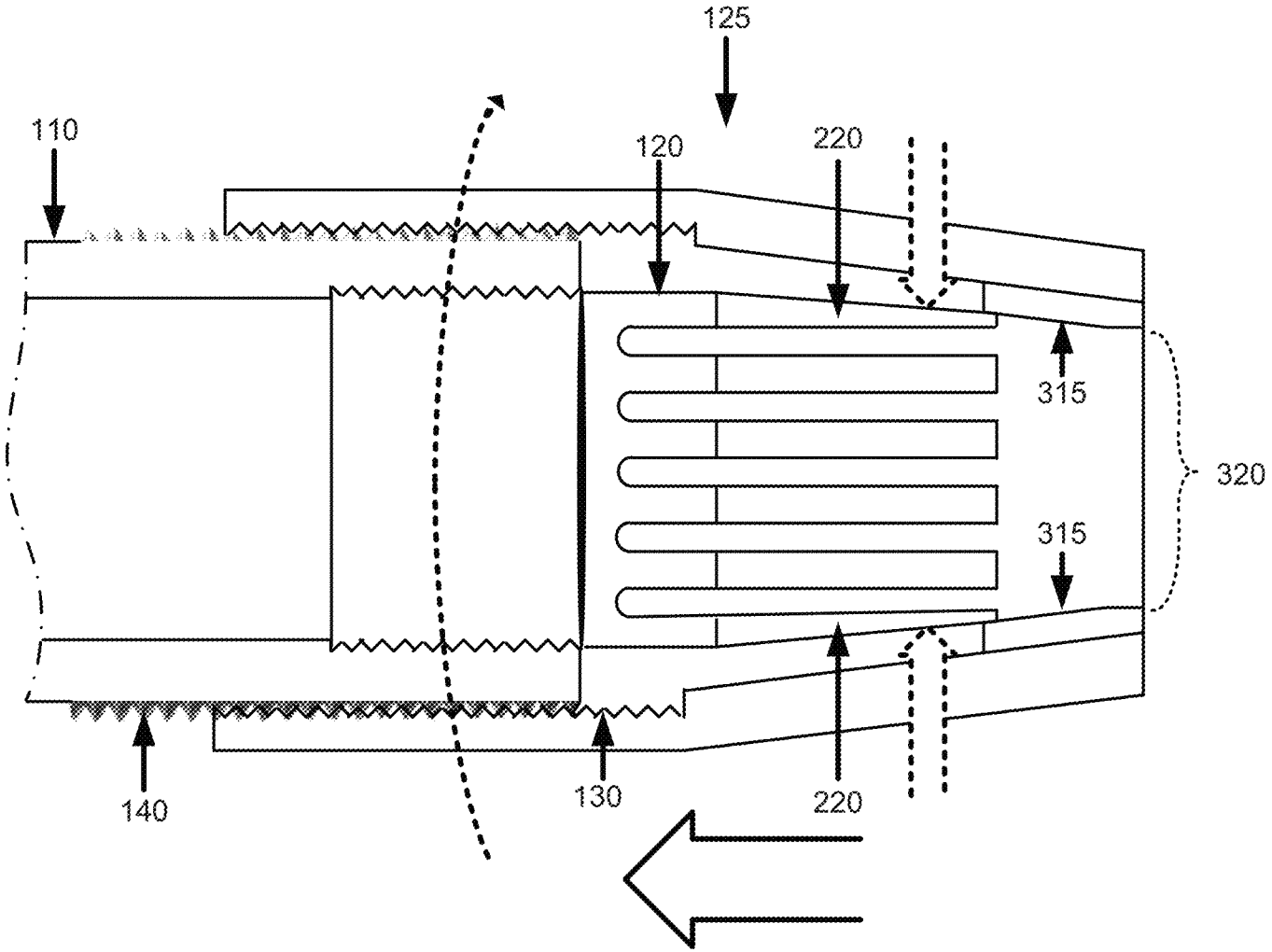
Figure 3C:
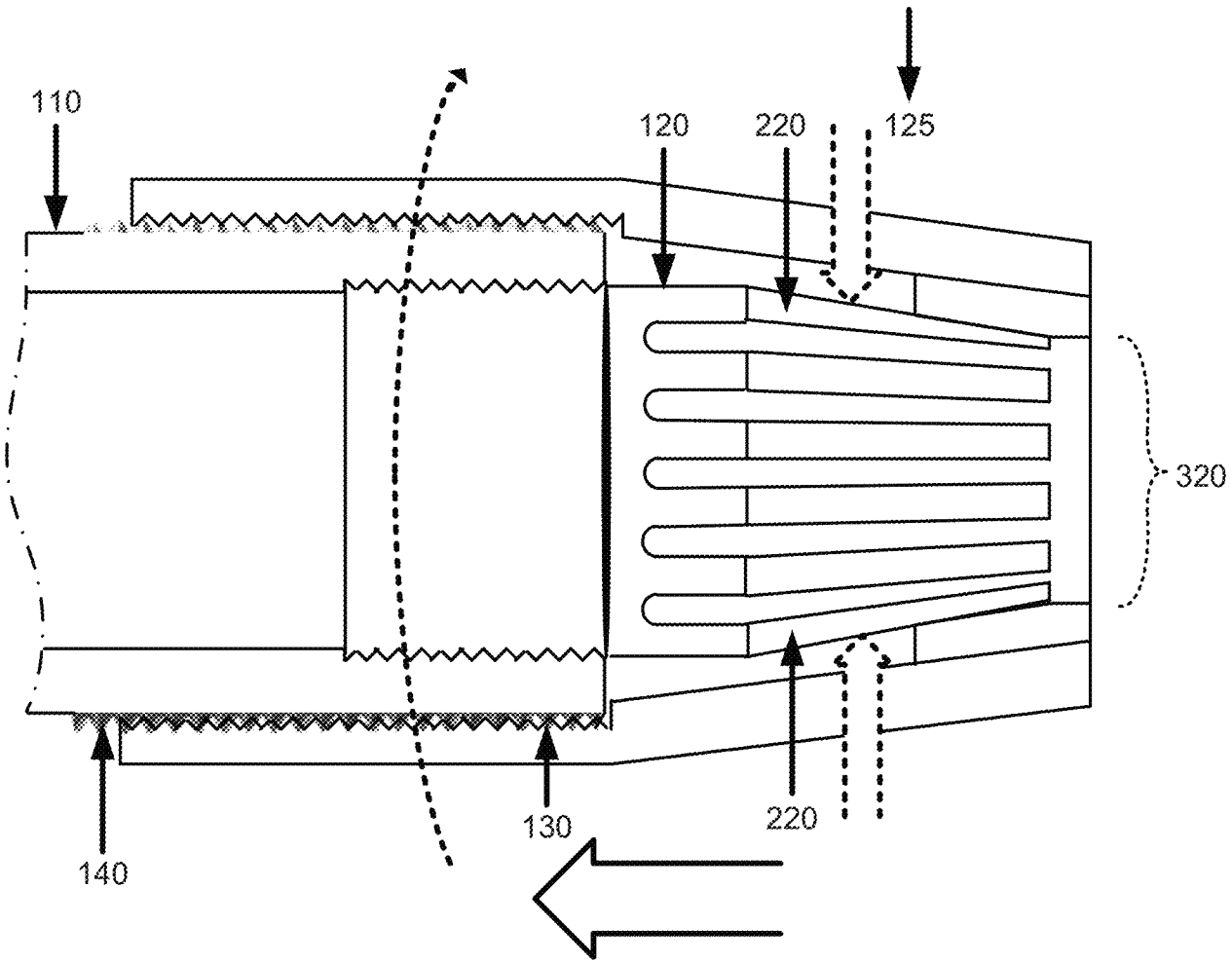

FIGS. 3A-3C depict an example of the threading of the interior threads 130 of outer choke sleeve 125 onto the exterior threads 140 of barrel 110 for increasing the choke constriction that inner choke sleeve 120 applies to shot balls fired out of barrel 110. FIG. 3A depicts outer choke sleeve 125 beginning to be threaded onto barrel 110. As shown, outer choke sleeve 125 includes a roughly cylindrical choke threading base 300 and a choke nozzle 305. The interior threads 130 reside on an inner surface of choke threading base 300. Choke nozzle 305 has an exterior surface shaped as, for example, a conical frustum, and an interior surface 310 also shaped as a conical frustum having a diameter that is less than the diameter of the exterior surface of choke nozzle 305. Choke nozzle 305 further includes a shot egress outlet 320 from which the fired shot balls exit the choke nozzle 305. A choke sleeve constrictor 315 may be formed on, or fastened to, the interior surface 310 of choke nozzle 305 adjacent to shot egress outlet 320. Choke constrictor 315 applies constriction to the elongated constriction fingers 220 of inner choke sleeve 120 as outer choke sleeve 125 is threaded onto the muzzle end 205 of barrel 110. Choke constrictor 315 includes a collar, formed on, or fastened to, the interior surface 310 of choke nozzle 305, having an appropriate thickness for applying a desired amount of constriction to the elongated constriction fingers 220 of inner choke sleeve 120 as outer choke sleeve 125 is threaded onto barrel 110.

FIG. 3B illustrates the continued threading of outer choke sleeve 125 onto barrel 110, and the beginning of application of constriction by choke constrictor 315 to the flexible elongated constriction fingers 220 of inner choke sleeve 120. As the female interior threads 130 of outer choke sleeve 125 are threaded onto the exterior male threads 140 of barrel 110, the elongated constriction fingers 220 of inner choke sleeve 120 come into contact with choke constrictor 315, which begins forcing the elongated constriction fingers 220 in an inward direction (shown with dashed arrows in FIG. 3B) due to a shape of the inner surface of choke constriction 315.

FIG. 3C illustrates the threading of outer choke sleeve 125 onto barrel 110 to cause a maximum constriction by choke constrictor 315 (referred to herein as "choke constriction") to the flexible, elongated constriction fingers 220 of inner choke sleeve 120. As the female interior threads 130 of outer choke sleeve 125 are continued to be threaded onto the exterior male threads 140 of barrel 110, the elongated constriction fingers 220 of inner choke sleeve 120 are caused to increasingly constrict, in an inward direction (shown with dashed arrows in FIG. 3C), to achieve a maximum amount of choke constriction of shot balls fired through barrel 110 and out through shot egress outlet 320 to exit choke nozzle 305 of outer choke sleeve 125.

The increasing of the choke constriction depicted in the example of FIGS. 3A-3C may be reversed to decrease the choke constriction. Therefore, the interior threads 130 of outer choke sleeve 120 may be de-threaded from the exterior threads 140 of barrel 110, by rotating outer choke sleeve 120 in an opposite direction to that shown in FIGS. 3A-3C, to cause the elongated constriction fingers 220 of inner choke sleeve 120 to decrease their constriction, in an outwards direction, to decrease the amount of choke constriction of shot balls fired through barrel 110 and out through shot egress outlet 320 to exit choke nozzle 305 of outer choke sleeve 125.

Figure 4:
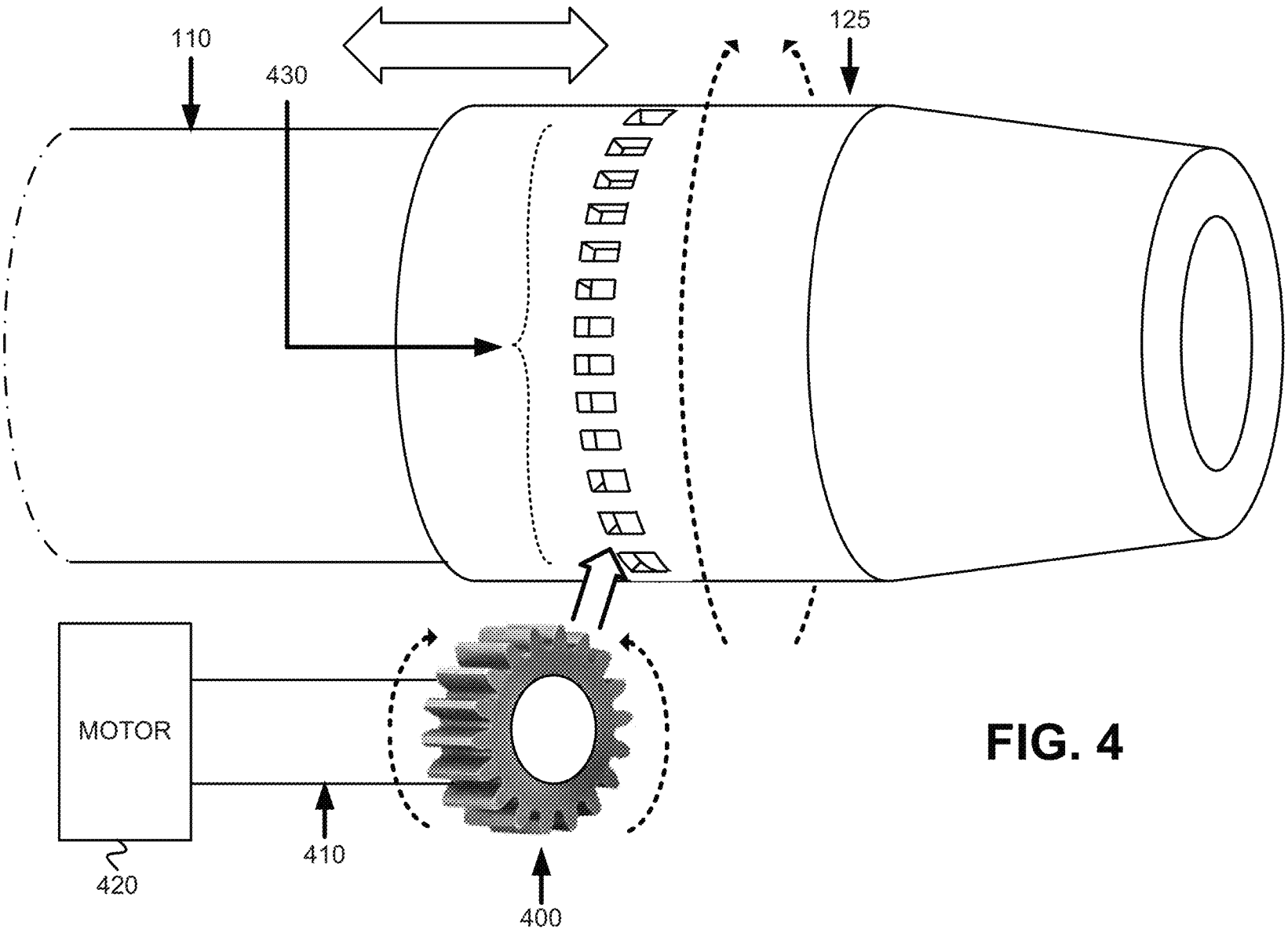
FIG. 4 illustrates a simplified example of one exemplary mechanism for causing the outer choke sleeve of the variable choke to be threaded or de-threaded on the punt gun's barrel to increase or decrease choke constriction.

FIG. 4 illustrates a simplified example of one exemplary mechanism for causing outer choke sleeve 125 to be threaded or de-threaded on barrel 110 to increase or decrease choke constriction. As shown, the exemplary mechanism may include a gear 400, attached to a gear shaft 410, and driven by a motor 420. Gear 400 further includes gear teeth that engage with corresponding gear teeth notches 430 extending around a perimeter of the external surface of choke threading base 300 of outer choke sleeve 125. As gear 400 is rotated in a first direction by motor 420 via gear shaft 410, outer choke sleeve 125 is threaded onto barrel 110 to increase the constriction applied to the elongated constriction fingers 220 (not shown) of inner choke sleeve 120 (not shown). As gear 400 is rotated in a second direction, opposite to the first direction, by motor 420 via gear shaft 410, outer choke sleeve 125 is de-threaded from barrel 110 to decrease the construction applied to the elongated constriction fingers 220 (not shown) of inner choke sleeve 120 (not shown).

Figure 5A:
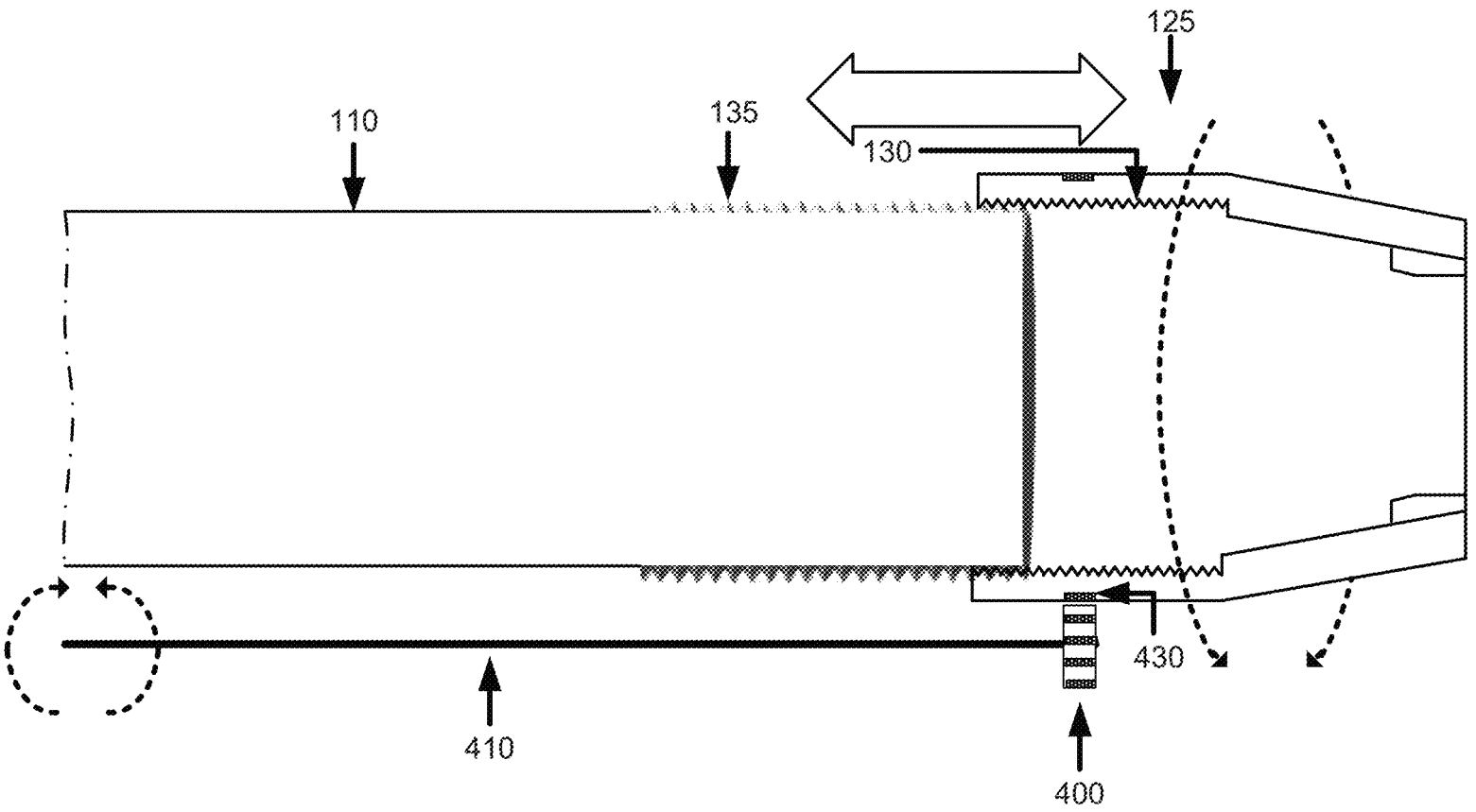
FIG. 5A illustrates an example of operation of the exemplary mechanism of FIG. 4 for causing the outer choke sleeve to increase or decrease choke constriction.

FIG. 5A illustrates an example of the operation of the exemplary mechanism of FIG. 4 for causing outer choke sleeve 125 to increase or decrease choke constriction. Gear shaft 410 is rotated in a first direction by motor 420 (not shown), causing gear 400 to rotate in the same first direction. As gear 400 rotates in the first direction, the gear teeth of the gear 400 engage with gear teeth notches 430 in the external surface of choke threading base 300 of outer choke sleeve 125, causing outer choke sleeve 125 to rotate in an opposite, second direction to the rotation of gear 400. As outer choke sleeve 125 rotates in the opposite direction to the rotation of gear 400, the interior female threads 130 are threaded onto the exterior male threads 140 of barrel 110 causing outer choke sleeve 125 to move inwards (the left arrow direction shown in FIG. 5A) onto barrel 110.

As gear 400 rotates in a second direction, opposite to the first direction, the gear teeth of the gear 400 engage with the gear teeth notches 430 in the external surface of choke threading base 300 of outer choke sleeve 125, causing outer choke sleeve 125 to rotate in an opposite, first direction to the rotation of gear 400. As outer choke sleeve 125 rotates in the opposite, first direction to the rotation of gear 400, the interior female threads 130 are de-threaded from the exterior male threads 140 of barrel 110 causing outer choke sleeve 125 to move outwards (the right arrow direction shown in FIG. 5A) from barrel 110.

Figure 5C:
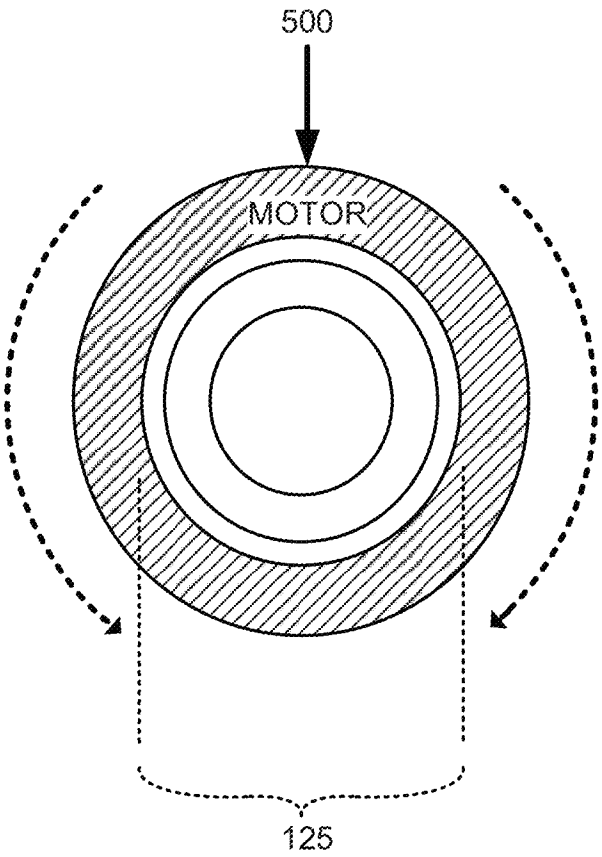
FIGS. 5B and 5C illustrate another exemplary mechanism for causing the outer choke sleeve to increase or decrease choke constriction.
Figure 5B:
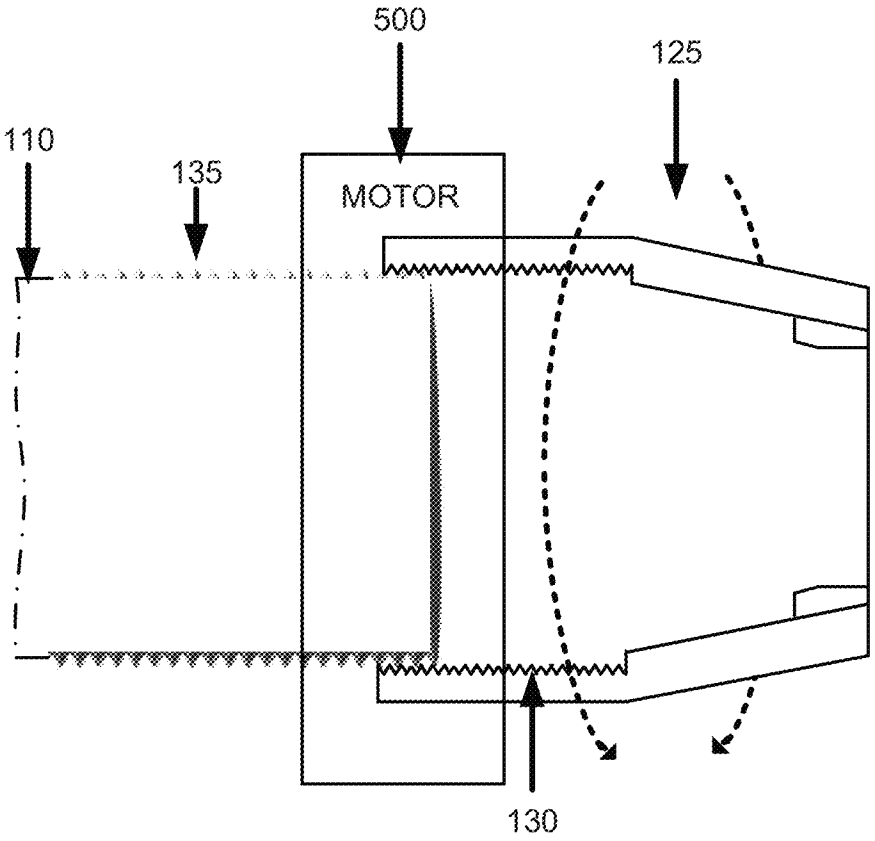

FIGS. 5B and 5C illustrate another exemplary mechanism for causing outer choke sleeve 125 to increase or decrease choke constriction. In this exemplary implementation, an electric motor 500 may be attached to outer choke sleeve 125 such that electrical control signals applied to electric motor 500 cause outer choke sleeve 125 to rotate relative to barrel 110 in a precisely controlled fashion. Changing of the electrical control signals causes the electric motor 500 to rotate in two different directions causing outer choke sleeve 125 to rotate in correspondingly different directions so as to thread sleeve 125 onto barrel 110, or de-thread sleeve 125 off of barrel 110. A control unit (not shown in FIGS. 5B and 5C) applies appropriate control signals to motor 500 to cause motor to induce rotation in outer choke sleeve 125 in the two different rotational directions (shown with two different arrows in FIGS. 5B and 5C).

Figure 5D:
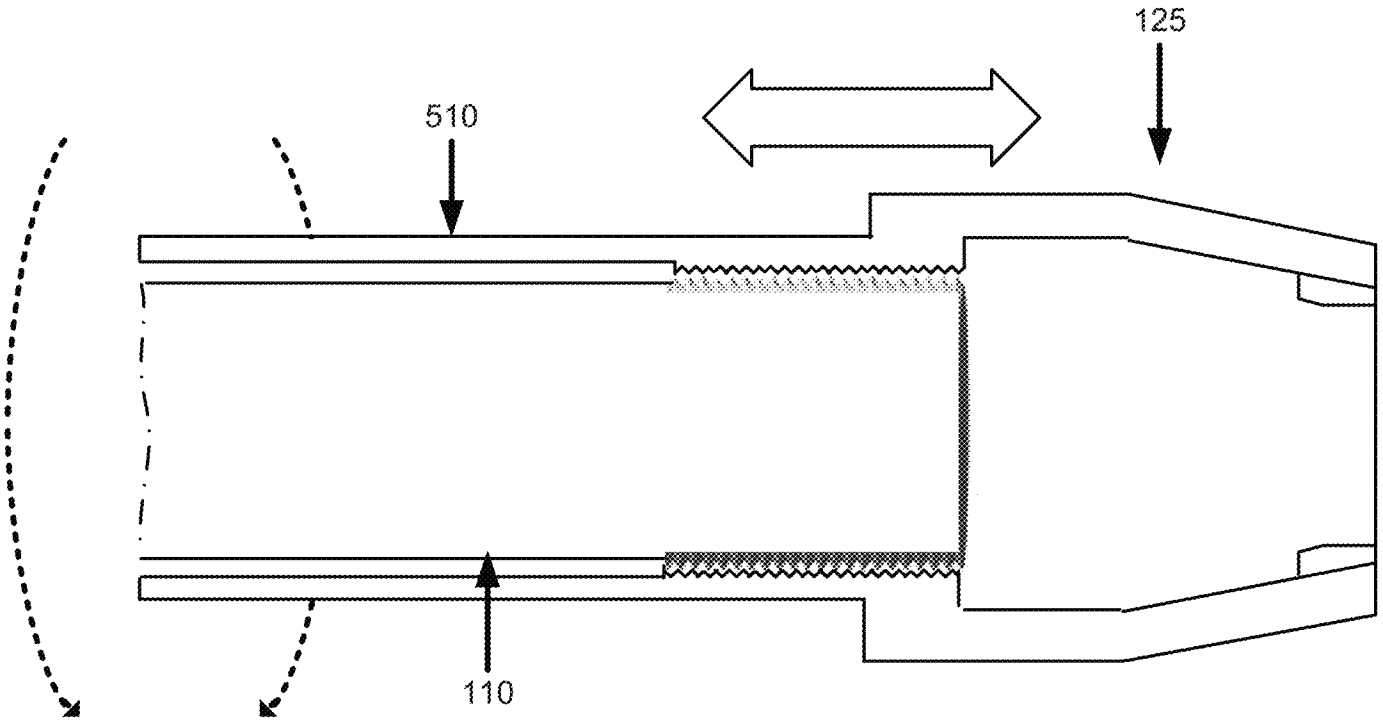
FIG. 5D illustrates yet another exemplary mechanism for causing the outer choke sleeve to increase or decrease choke constriction.

FIG. 5D illustrates yet another exemplary mechanism for causing outer choke sleeve 125 to increase or decrease choke constriction. In this exemplary implementation, outer choke sleeve 125 may be connected to a barrel housing 510 that extends along a length of barrel 110. A motor (not shown) applies a precise amount of rotation to the barrel housing 510 (e.g., at the base of the barrel 110), causing outer choke sleeve 125 to also rotate at the muzzle end of barrel 110. The motor may apply rotation in two different directions to cause the barrel housing 510 and outer choke sleeve 125 to rotate in the two different directions so as to thread sleeve 125 onto barrel 110, or de-thread sleeve 125 off of barrel 110, thereby increasing or decreasing the choke constriction.

Figure 6:
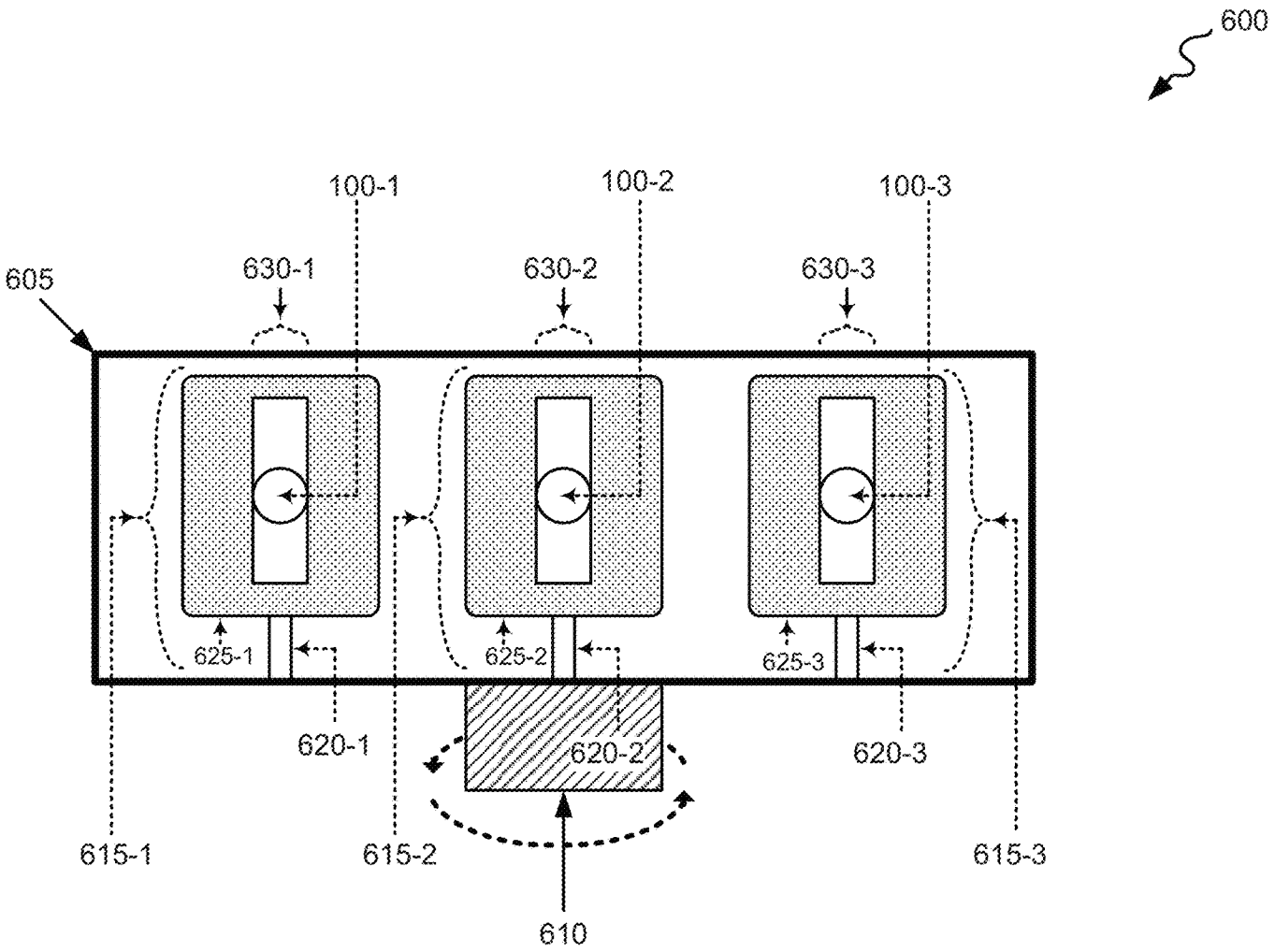
FIG. 6 depicts a multiple punt gun defense system according to a first exemplary embodiment.

FIG. 6 depicts a multiple punt gun defense system 600 according to a first exemplary embodiment. Punt gun defense system 600 includes a platform 605, supported by a base structure 610, in which multiple punt gun assemblies 615-1 through 615-3 are mounted. As shown, base structure 610 may be rotatable using a motor and control system (not shown) thereby also causing platform 605, which is mounted upon base structure 610, to rotate. Each of punt gun assemblies 615-1 through 615-3 are mounted upon respective swiveling supports 620-1 through 620-3 which each can rotate a certain amount, using a control system and an independent motor for each swiveling support 620, as described in further detail below with respect to FIGS. 9A-9C.

Each of punt gun assemblies 615-1 through 615-3 includes a respective punt gun housing 625-1 through 625-3. Punt gun housing 625-1 mounts a first punt gun 100-1, the barrel of which extends out of a gun elevation aperture 630-1 of the punt gun housing 625-1. Punt gun housing 625-2 mounts a second punt gun 100-2, the barrel of which extends out of a gun elevation aperture 630-2 of the punt gun housing 625-2. Punt gun housing 625-3 mounts a third punt gun 100-3, the barrel of which extends out of a gun elevation aperture 630-3 of the punt gun housing 625-3. A control system and an independent motor system may cause each punt gun 100 to change its angle of elevation within its gun elevation aperture 630, as described in further detail below with respect to FIGS. 8A and 8B.

Figure 7:
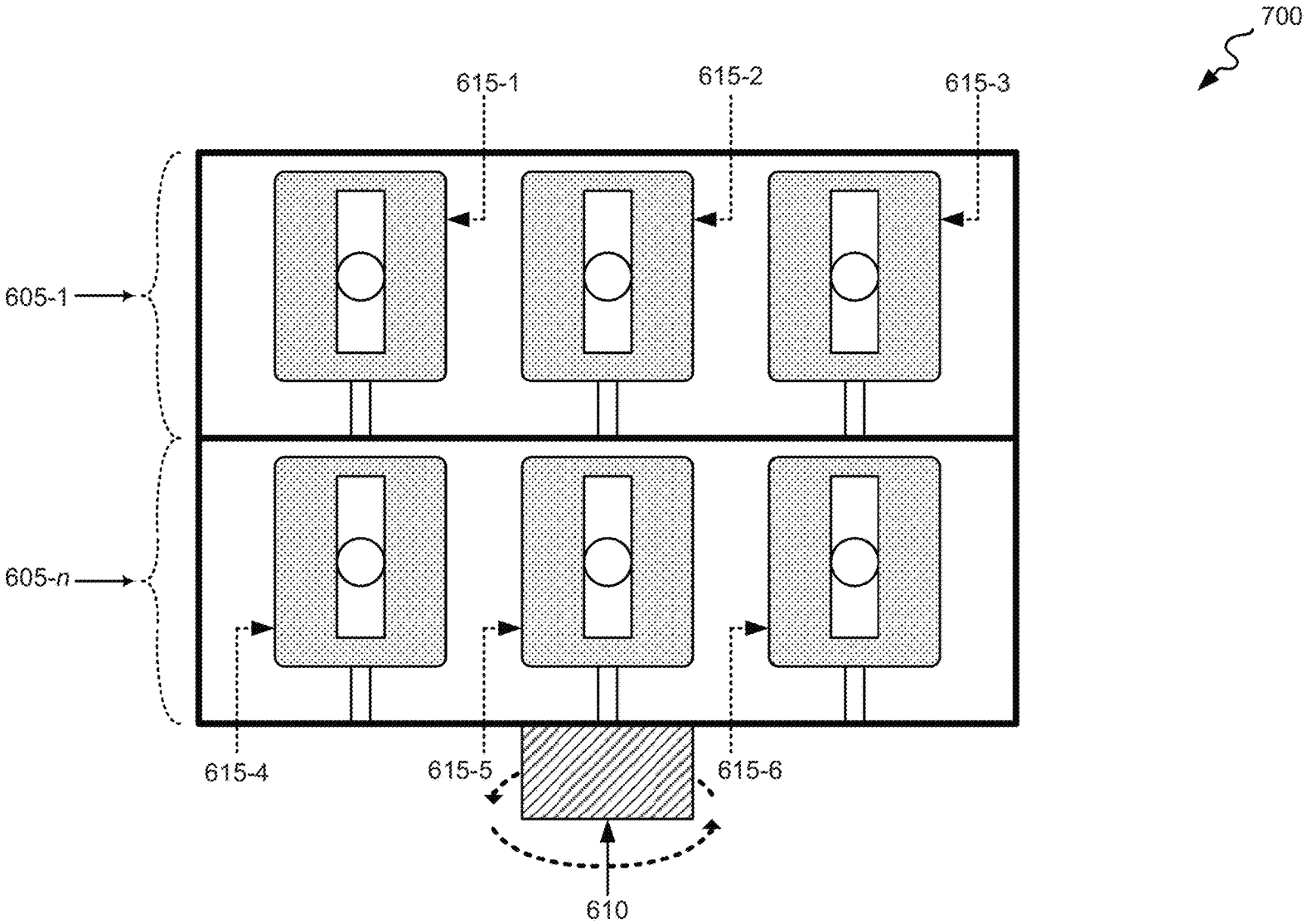
FIG. 7 depicts a multiple punt gun defense system according to a second exemplary embodiment.

FIG. 7 depicts a multiple punt gun defense system 700 according to a second exemplary embodiment. In this embodiment, punt gun defense system 700 includes multiple platforms 605-1 through **605-*n* (where n is greater than or equal to 2) supported by a base structure 610. Each of the multiple platforms 605-1 through 605-*n* mounts multiple punt gun assemblies 615. In the embodiment depicted in FIG. 7, platform 605-1 mounts punt gun assemblies 615-1 through 615-3, and platform 605-*n* mounts punt gun assemblies 615-4 through 615-6. Base structure 610 of defense system 700 may be rotatable using a motor and control system (not shown) thereby also causing the multiple platforms 605, which are mounted upon base structure 610 to rotate, as described above with respect to FIG. 6**.

Figure 8A:
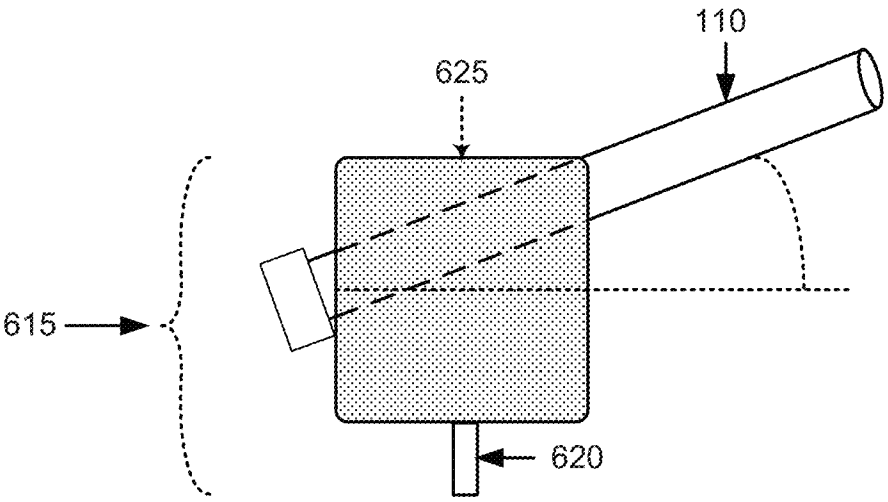
FIGS. 8A and 8B show the adjustment of an angle of elevation of the barrel of the variable choke punt gun within a gun elevation aperture of the punt gun assembly.
Figure 8B:
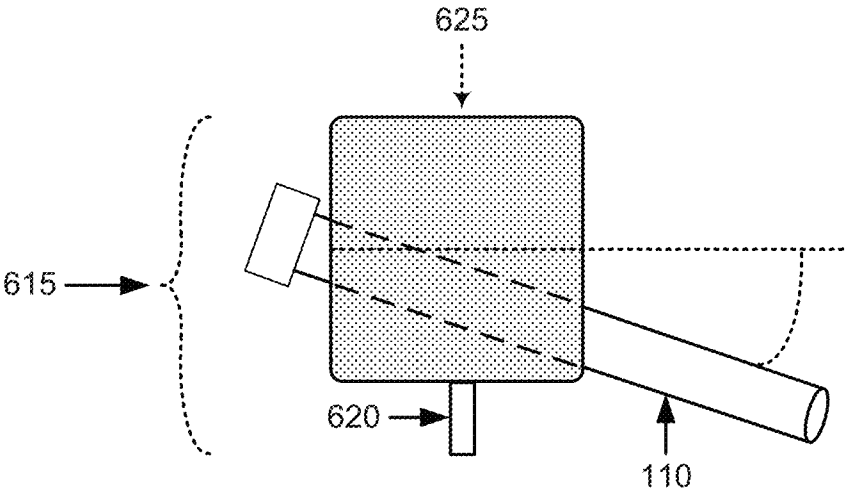

FIGS. 8A and 8B show the adjustment of an angle of elevation of barrel 110 of a variable choke punt gun 100 within a gun elevation aperture 630 (not shown) of the punt gun assembly 615. As depicted in FIG. 8A, punt gun 100 may have its elevation adjusted upwards, away from the swiveling support 620 to raise the aiming point of punt gun 100 upwards. As further depicted in FIG. 8B, punt gun 100 may have its elevation adjusted downwards, towards the swiveling support 620, to lower the aiming point of punt gun 100. The size of the gun elevation aperture 630 (not shown in FIGS. 8A and 8B), and/or a mechanical limit on the motor and its associated elevation adjustment components, may set an upper and lower limit to the amount of upwards and downwards elevation adjustment of punt gun 100 within punt gun assembly 615.

Figure 9A:
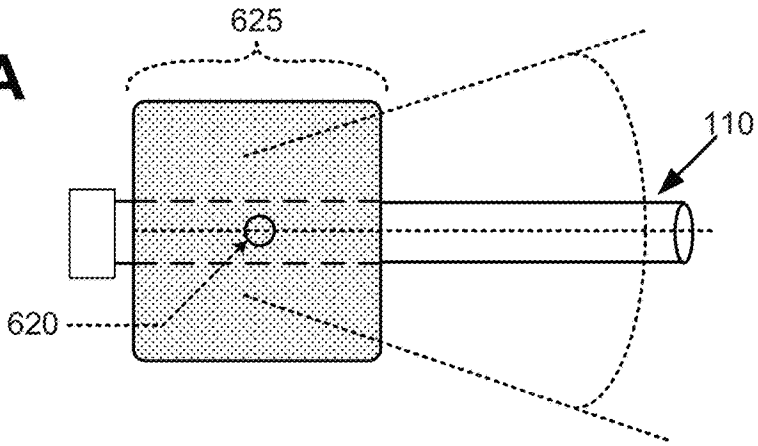
FIGS. 9A-9C show rotation adjustment of the punt gun housing, via rotation of the swiveling support, for changing a point of aim of the punt gun in a horizontal plane.
Figure 9B:
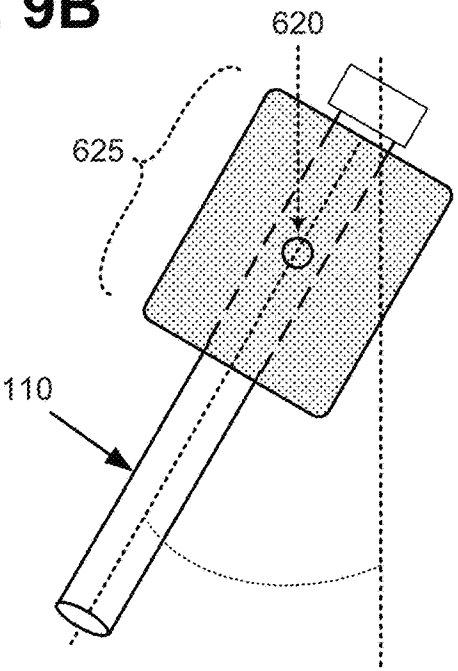
Figure 9C:
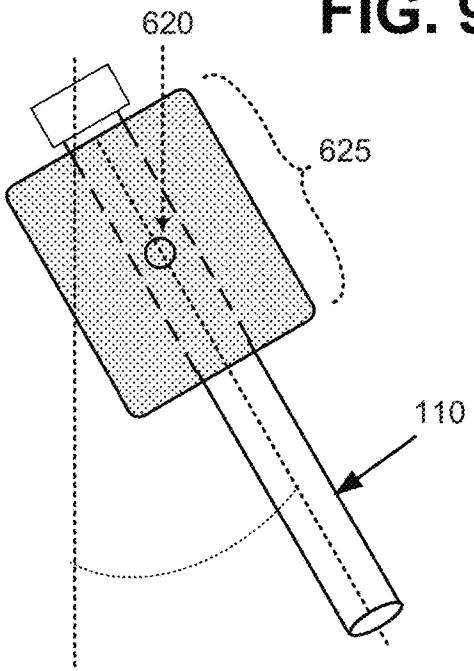

FIGS. 9A-9C show rotational adjustment of punt gun housing 625, via rotation of swiveling support 620, for changing a point of aim of punt gun 100 in a horizontal plane. FIG. 9A depicts a centerline of punt gun assembly 615 when the aiming point of punt gun 100, in the horizontal plane, is at the center of its range of adjustment. By using a motor to rotate swiveling support 620 or punt gun housing 625, the aiming point of punt gun 100 may be adjusted leftwards, or rightwards, relative to the centerline of punt gun assembly 615. FIG. 9B depicts the rotation of swiveling support 620 (or punt gun housing 625) to move the aiming point of punt gun 100 in a rightwards direction in the horizontal plane relative to the centerline. FIG. 9C further depicts the rotation of swiveling support 620 (or punt gun housing 625) to move the aiming point of punt gun 100 in a leftwards direction in the horizontal plane relative to the centerline. A leftwards or rightwards limit may exist on the horizontal plane adjustment of punt gun 100 due to, for example, the proximity of an adjacent punt gun assembly 615, or the proximity of a structure of platform 605.

Figure 10:
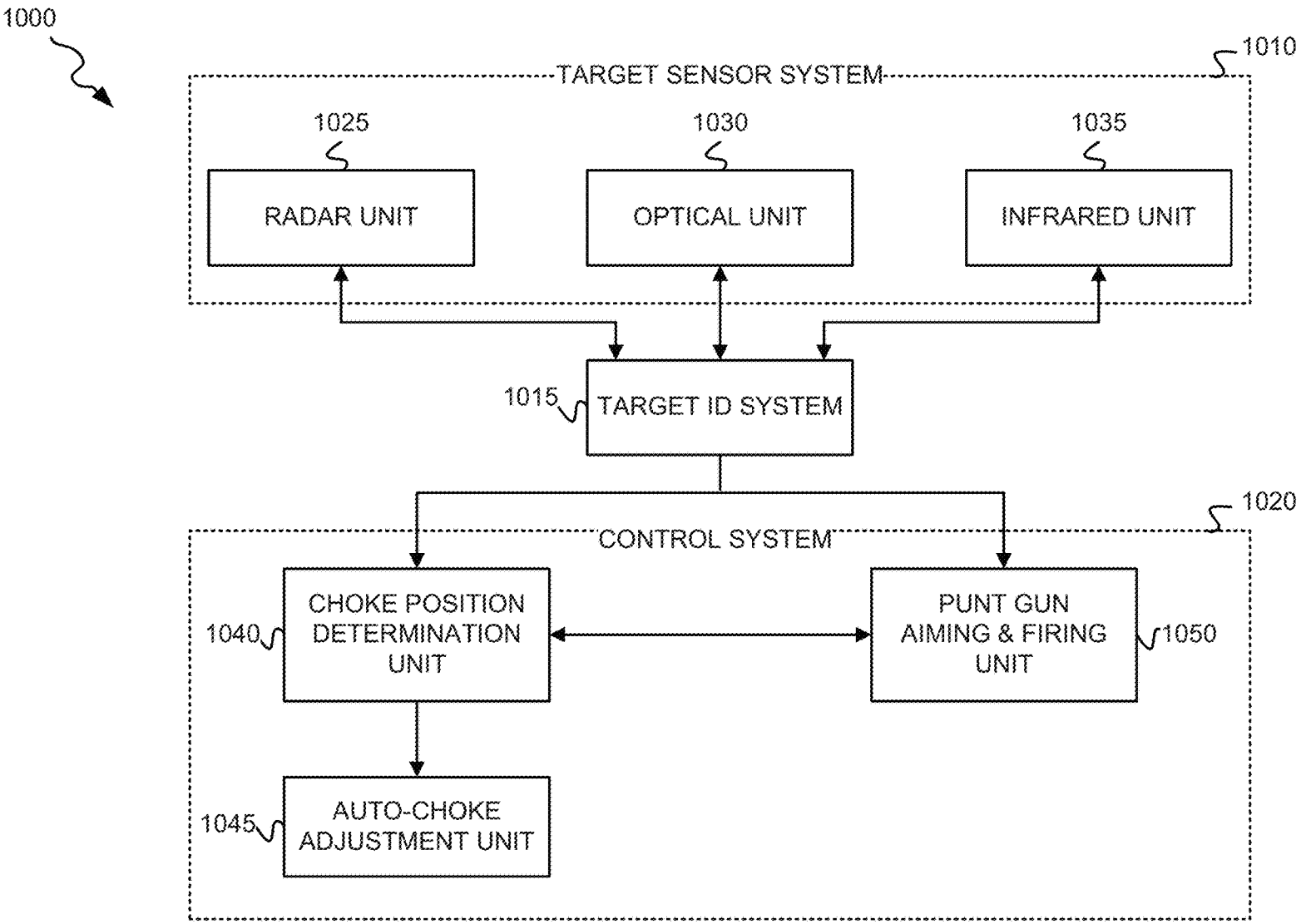
FIG. 10 illustrates a system associated with the operation of the automated variable choke punt gun described herein.

FIG. 10 illustrates a system 1000 associated with the operation of automatic variable choke punt gun 100 described herein. System 1000 depicted in FIG. 10 represents functional components involved in the operation and control of automatic variable choke punt gun 100. The functional components of system 100 may, as shown, include a target sensor system 1010, a target identifier (ID) system 1015, and a control system 1020.

Target sensor system 1010 may include a radar unit 1025, an optical unit 1030, and/or an infrared unit 1035. Radar unit 1025 includes one or more devices and components for using radio waves to detect targets in a vicinity of radar unit 1025, and to determine the position, range, velocity, acceleration, size, shape, and/or cross-sectional area of those targets. Optical unit 1030 includes one or more devices and components for using, for example, the visible spectrum to visually detect and identify targets, and to assist in determining the position, range, velocity, acceleration, size, shape, and/or cross-sectional area of those targets. Infrared unit 1035 includes one or more devices and components for using the infrared spectrum to detect and identify targets and to assist in determining the position, range, velocity, acceleration, size, shape and/or cross-sectional area of those targets.

Target ID system 1015 includes a computational system that monitors the target sensor data generated by target sensor system 1010 and identifies the positions, ranges, direction of motion, velocity, and acceleration, of individual targets, and the distribution of targets within a region of space (e.g., the distribution of targets within a three-dimensional region of sky). Target ID system 1015 may further analyze the sensor data generated by target sensor system 1010 to determine a size, shape, and/or cross-sectional area of each individual target within the region of space. The computational system of target ID system 1015 may additionally analyze the target sensor data generated by target sensor system 1010 to identify the nature of individual targets, such as whether the individual targets are aerial drones, flying birds, or manned airplanes, and to determine whether the individual targets may or may not represent a threat so as to justify shooting them with an automatic variable choke punt gun 100.

Control system 1020, as shown in FIG. 10, may further include a choke position determination unit 1040, an auto-choke adjustment unit 1045, and a punt gun aiming unit 1050. Choke position determination unit 1040 determines an amount of constriction currently applied by the variable choke mechanism 115 of punt gun 100. Choke position determination unit 1040 keeps track of the current state (e.g., position, rotation, etc.) of the components of variable choke mechanism 115 used to increase or decrease choke constriction applied to outgoing fired shot.

Auto-choke adjustment unit 1045 applies control signals to adjust the amount of constriction applied by the variable choke mechanism 115 of punt gun 100. Auto-choke adjustment unit 1045, based on the known amount of constriction currently applied by the variable choke mechanism 115, as determined by choke position determination unit 1040, may, in the exemplary implementation of FIG. 4, apply a control signal(s) to motor 420 to cause gear shaft 410 to rotate, further causing gear 400 to rotate in either a first direction or a second, opposite direction. As gear 400 is rotated in the first direction by motor 420 via gear shaft 410, gear teeth of gear 400 engage with corresponding gear teeth notches 430 of the external surface of outer choke sleeve 125 to cause outer choke sleeve 125 to thread onto barrel 110, thereby increasing the constriction applied to the elongated constriction fingers 220 of inner choke sleeve 120. As gear 400 is rotated in the second direction by motor 420 via great shaft 410, gear teeth of gear 400 engage with corresponding gear teeth notches 430 of the external surface of outer choke sleeve 125 to cause outer choke sleeve 125 to de-thread from barrel 110, thereby decreasing the construction applied to the elongated constriction fingers 220 of inner choke sleeve 120.

Punt gun aiming unit 1050 applies control signals to mechanical mechanisms that orientate the barrel 110 of punt gun 100 in a specific direction towards a particular aiming point that is based on the positions, ranges, direction of motion, velocity, acceleration, size, shape, and/or cross-sectional area of individual targets identified by target ID system 1015. Examples of the aiming of punt gun 100, based on control signals generated by punt gun aiming unit 1050, are depicted in FIGS. 8A and 8B (i.e., changing the elevation of the barrel 110 of punt gun 110 relative to a vertical centerline), and FIGS. 9A-9C (i.e., traversing the angle of the barrel 110 relative to a horizontal centerline).

The configuration of components of system 1000 shown in FIG. 10 is for illustrative purposes. Other configurations may be implemented. Therefore, system 1000 may include additional, fewer and/or different components, arranged in a different configuration, then depicted in FIG. 10.

Figure 11:
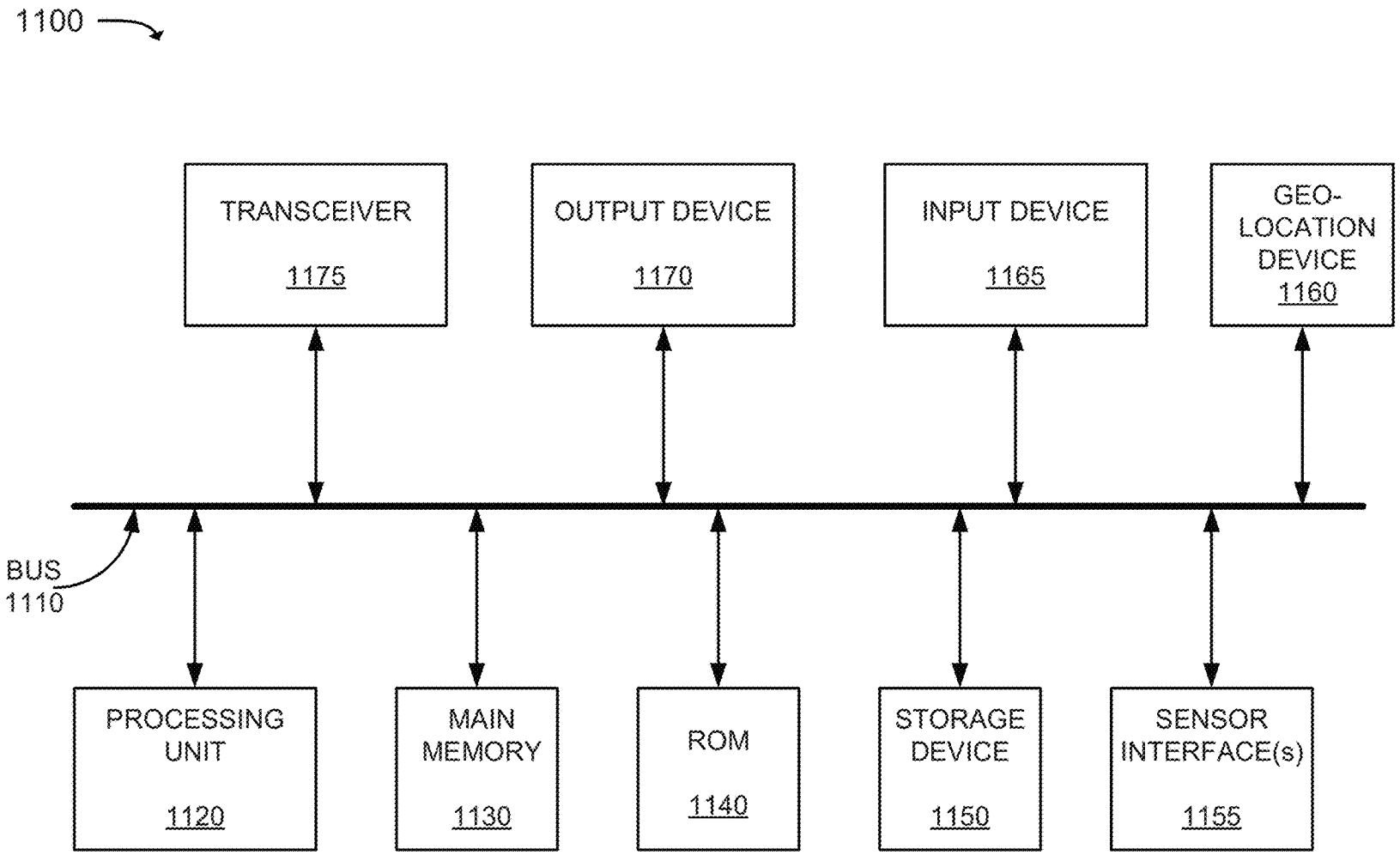
FIG. 11 is a diagram that depicts exemplary device components of a system associated with the operation and control of the automated variable choke punt gun.

FIG. 11 is a diagram that depicts exemplary physical device components of a system 1100 associated with the operation and control of an automatic variable choke punt gun 100 or multiple automatic variable choke punt guns 100. Target sensor system 1010, target ID system 1015 and/or control system 1020 may each include components configured similarly to system 1100 shown in FIG. 11, possibly with some variations in components and/or configuration. System 1100 may include a bus 1110, a processing unit 1120, a main memory 1130, a read only memory (ROM) 1140, a storage device 1150, a sensor interface(s) 1155, a geolocation device 1160, an input device 1165, an output device 1170, and a transceiver 1175.

Bus 1110 includes a path that permits communication among the components of system 1100. Processing unit 1120 may include one or more processors or microprocessors which may interpret and execute stored instructions associated with one or more processes, or processing logic that implements the one or more processes. In some implementations, processing unit 1120 may include programmable logic such as, for example, Field Programmable Gate Arrays (FPGAs) or accelerators. Processing unit 1120 may include software, hardware, or a combination of software and hardware for executing the process(es) described herein.

Main memory 1130 may include a random access memory (RAM), or another type of dynamic storage device, that may store information, and instructions for execution by processing unit 1120. ROM 1140 may include a ROM device, or another type of static storage device (e.g., Electrically Erasable Programmable ROM (EEPROM)), that may store static information and, in some implementations, instructions for use by processing unit 1120. Storage device 1150 may include a magnetic and/or optical recording medium and its corresponding drive. Main memory 1130, ROM 1140 and storage device 1150 may each be referred to herein as a "non-transitory computer-readable medium" or a "non-transitory storage medium."

Sensor interface(s) 1155 may include components for electrically interfacing with sensors of target sensor system 1010, such as, for example, radar unit 1025, optical unit 1030, and/or infrared unit 1035. Sensor interface(s) 1155 receives signals/data from the sensors of target sensor system 1010, and sends control signals/data to the sensors of target sensor system 1010.

Geo-location device 1160 includes a device that determines a current geographic location of system 1100. Geo-location device 1160 may, for example, include a digital compass that determines a current heading of system 1100. Geo-location device 1160 may additionally, or alternatively, include a Global Positioning System (GPS) device that determines, using a GPS satellite system, a current geographic position of system 1100. The geographic position may be tracked over time to determine a velocity, acceleration, and/or a heading of system 1100.

Input device 1165 may include one or more devices that permit an operator to input information to system 1100, such as, for example, a keypad or a keyboard, a display with a touch sensitive panel, voice recognition and/or biometric mechanisms, etc. Output device 1170 may include one or more devices that output information to an operator or user, including a display (e.g., with a touch sensitive panel), a speaker, etc. Input device 1165 and output device 1170 may be implemented as a graphical user interface (GUI) (e.g., a touch screen GUI that uses any type of touch screen device) that displays GUI information and which receives user input via the GUI.

Transceiver 1175 may include one or more wired or wireless transceivers (e.g., transmitters and/or receivers) that enable system 1100 to communicate with other devices and/or systems via various different types of wired or wireless links, or wired or wireless networks. For example, transceiver 1175 may include one or more transceivers for communicating via a wired or wireless local area network (LAN), a wired or wireless wide area network (WAN), a wired or wireless metropolitan area network (MAN), a wired or wireless Personal Area Network (PAN), an intranet, the Internet, and/or a Mobile Network. The Mobile Network may include, for example, a Public Land Mobile Network (PLMN) or a Satellite Network. The PLMN may include, for example, a Code Division Multiple Access (CDMA) 2000 PLMN, a Global System for Mobile Communications (GSM) PLMN, a Long Term Evolution (LTE) PLMN (e.g., such as a fourth or fifth-generation (4G or 5G) LTE network), and/or other types of PLMNs. The wireless LAN(s) includes one or more wireless LANs of any type, such as, for example, a Wi-Fi network that operates according to the IEEE 802.11 standard. The wireless PAN includes any type of PAN carried over a low power, short range wireless protocol such as, for example, Bluetooth™, Insteon, Infrared Data Association (IrDA), wireless Universal Serial Bus (USB), Z-Wave, ZigBee, and/or Body Area Network (BAN). The reach of the wireless PAN may vary from a few meters to tens of meters, depending on the specific short range wireless protocol used and the range needed to reach a closest wireless station.

The configuration of components of system 1100 shown in FIG. 11 is for illustrative purposes. Other configurations may be implemented. Therefore, system 1100 may include additional, fewer and/or different components, arranged in a different configuration, than depicted in FIG. 11.

Figure 12A:
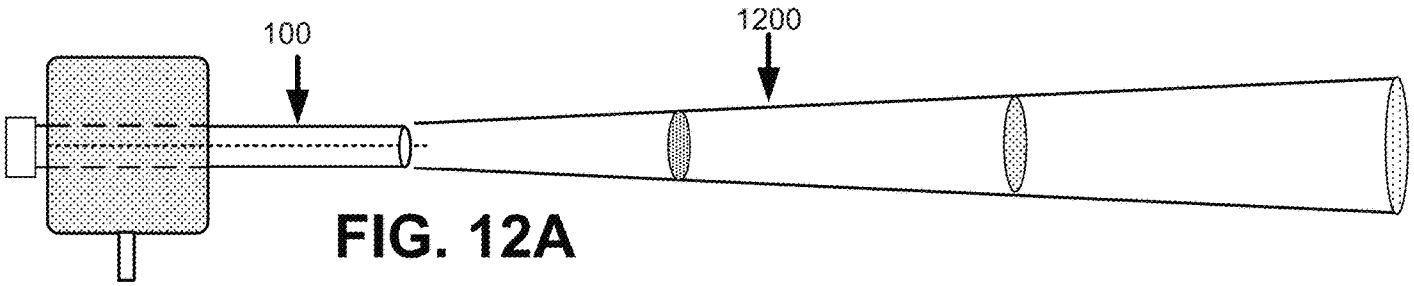
FIGS. 12A-12C depict examples of the adjustment of the variable choke of the automated variable choke punt gun and the choke adjustment's effect on the shot pattern.
Figure 12B:
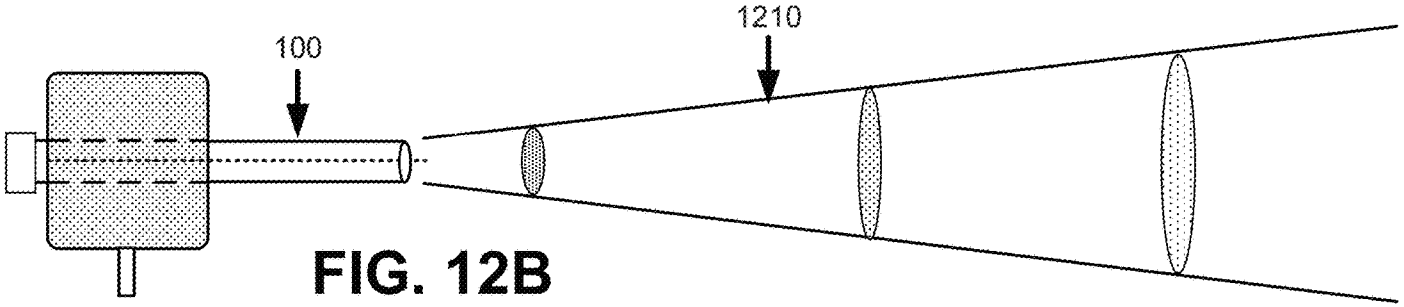
Figure 12C:
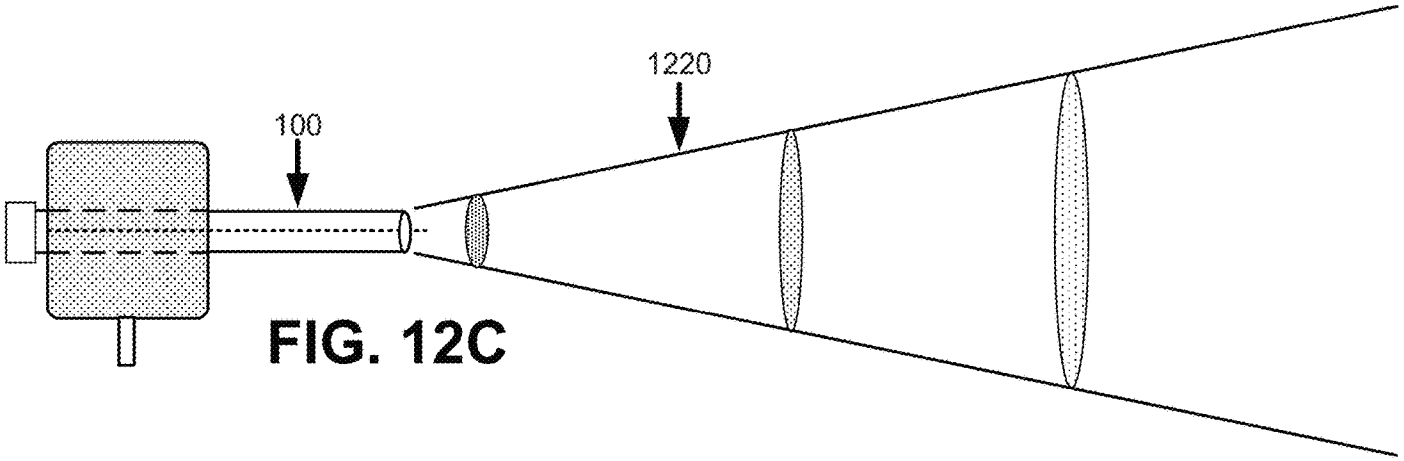

FIGS. 12A-12C depict examples of the adjustment of the variable choke of automated variable choke punt gun 100 and the choke adjustment's effect on shot pattern. As shown in FIG. 12A, punt gun 100 may have the variable choke adjusted to produce a narrow shot pattern 1200. When fired with the variable choke adjusted as shown in FIG. 12A, the shot balls, propelled outwards from the muzzle of punt gun 100, trace a shot pattern that encompasses a cone having a gradual increase in cross-sectional diameter from the muzzle of punt gun 100 to a target or targets (not shown). The narrow shot pattern 1200, therefore, concentrates the propelled shot balls in a limited cross-sectional area, thereby increasing the likelihood of multiple hits upon any target(s) within the shot pattern 1200.

As further shown in FIG. 12B, punt gun 100 may have the variable choke adjusted to produce a medium shot pattern 1210. When fired with the variable choke adjusted as shown in FIG. 12B, the shot balls, propelled outwards from the muzzle of punt gun 100, trace a shot pattern that encompasses a cone having a moderate increase in cross-sectional diameter from the muzzle of punt gun 100 to a target or targets (not shown). The medium shot pattern 1210, therefore, spreads the propelled shot balls over a greater cross-sectional area relative to the narrow shot pattern 1200 of FIG. 12A. The medium shot pattern 1210 decreases the likelihood of multiple hits upon any target(s) within the shot pattern 1210, but increases the likelihood of at least a single hit upon multiple targets within the shot pattern 1210.

As additionally shown in FIG. 12C, punt gun 100 may have the variable choke adjusted to produce a wide shot pattern 1220. When fired with the variable choke adjusted as shown in FIG. 12C, the shot balls, propelled outwards from the muzzle of punt gun 100, trace a shot pattern that encompasses a cone having a large increase in cross-sectional diameter from the muzzle of punt gun 100 to a target or targets (not shown). The wide shot pattern 1220, therefore, spreads the propelled shot balls over a large cross-sectional area relative to the narrow shot pattern 1200 of FIG. 12A or the medium shot pattern 1210 of FIG. 12B. The wide shot pattern 1220 decreases the likelihood of multiple hits upon any target(s) within the shot pattern 1220, but increases the likelihood of at least a single hit upon multiple targets that are spaced apart within the shot pattern 1220.

Figure 13:
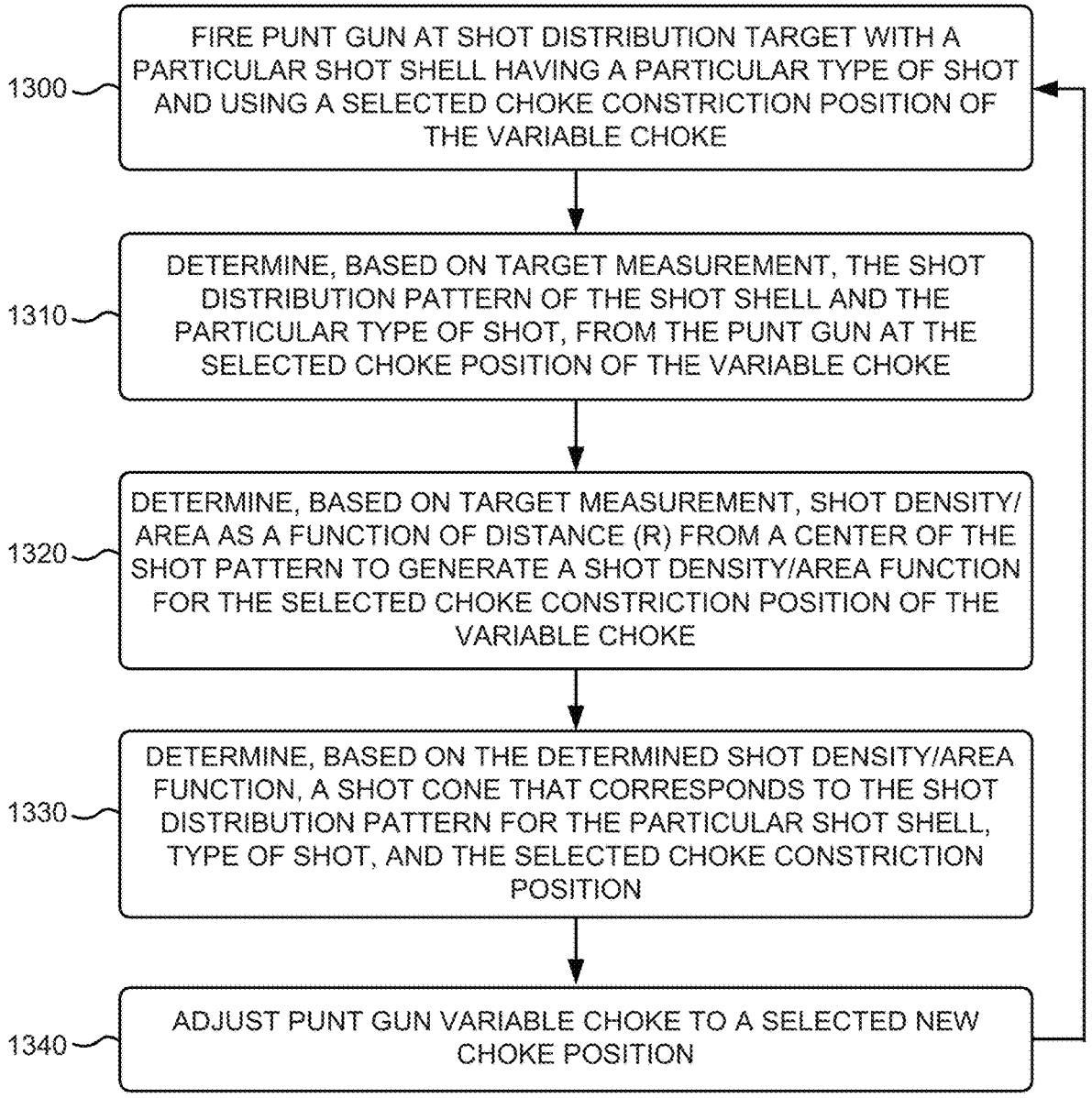
FIG. 13 is a flowchart that illustrates an exemplary process for characterizing the shot density as a function of distance at a selected choke position of the variable choke for a particular shot shell having a particular shot type fired from the automated variable choke punt gun.

FIG. 13 is a flowchart that illustrates an exemplary process for characterizing the shot density as a function of distance at a selected choke position of the variable choke, for a particular shot shell having a particular shot ball type, fired from automatic variable choke punt gun 100. In one embodiment, the exemplary process of FIG. 13 may be manually implemented. In other implementations, the exemplary process of FIG. 13 may be implemented by an automatic system that automatically registers shot hits upon a target, and automatically adjusts a distance between the target and a support structure supporting the automatic variable choke punt gun 100. The exemplary process of FIG. 13 is described below with reference to FIGS. 14A, 14B, and 15.

The exemplary process includes firing a punt gun 100 at a shot distribution target with a particular shot shell having a particular type of shot and using a selected choke position of the variable choke of the punt gun 100 (block 1300). The punt gun 100 may be disposed within a support structure (e.g., some type of rest) that is located a specified distance from the shot distribution target. A particular type of shot shell (e.g., with a particular amount and type of propellant) may be selected that is loaded with a particular type and size of shot balls. The type of shot ball may include, for example, a type of material from which the shot balls are made (e.g., steel, lead, a lead alloy, a composite material, etc.), and/or a particular shape and design of each shot ball. The size of the shot ball may include, for example, a diameter of the shot ball. A choke position (e.g., less constricted, more constricted) of the variable choke of the punt gun 100 is selected, the punt gun 100 is aimed at the shot distribution target, and the punt gun 100 is fired at the target.

Figure 14A:
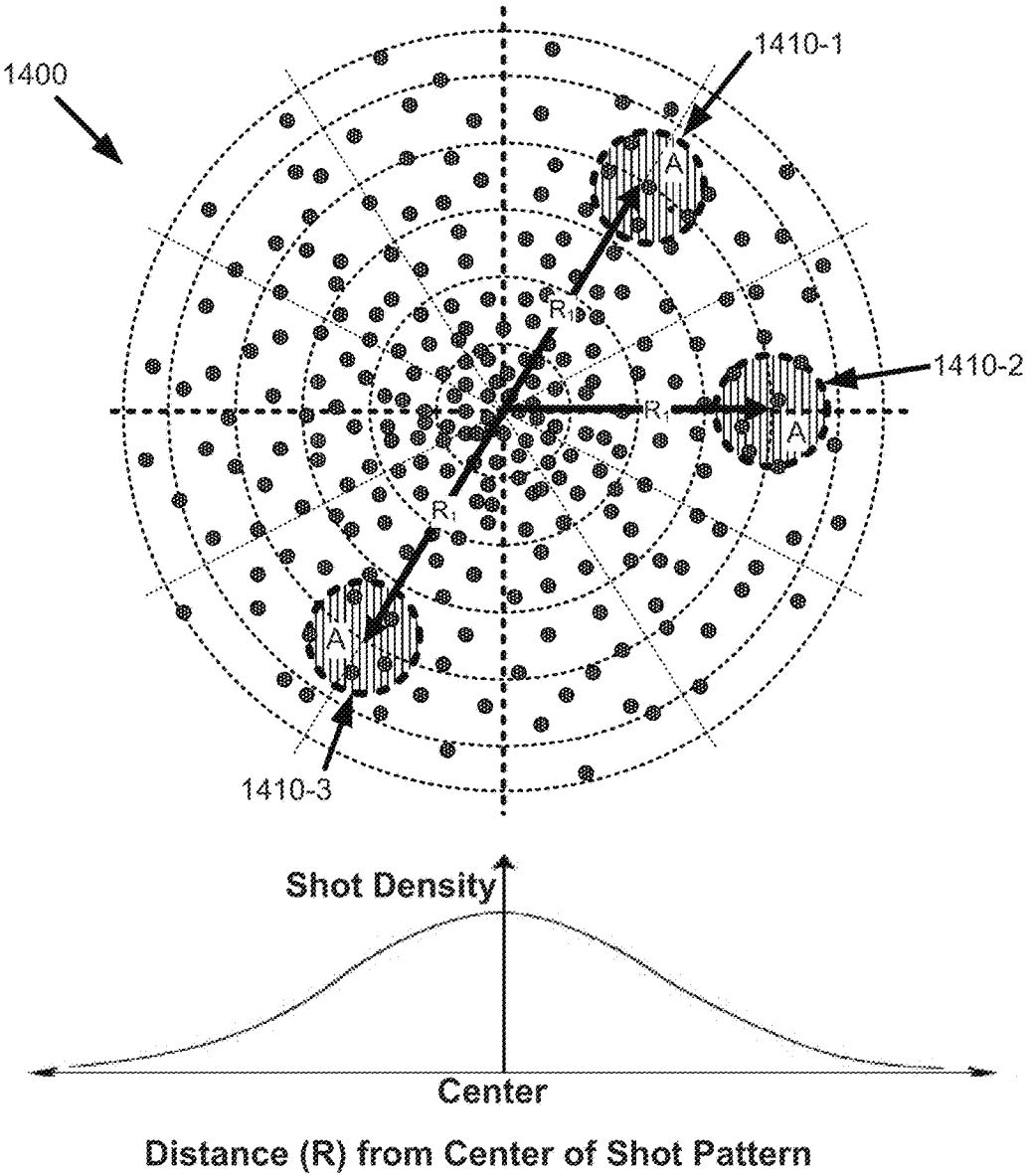
FIGS. 14A and 14B depict examples of shot density, upon an exemplary target, as a function of a distance (R) from the center of a shot pattern.

The process further includes determining, based on target measurement, a shot distribution pattern of the fired shot shell and the particular type of shot, from the punt gun 100 at the selected choke position of the variable choke (block 1310). If the shot distribution target is part of an automated system, the automated system registers the exact location of the hits of all shot balls impacting the shot distribution target. If the exemplary process is being manually implemented, the location of the hits of all shot balls impacting the shot distribution target may be manually measured and tabulated. FIG. 14A depicts an example of a shot distribution pattern of a fired shot shell that has impacted a shot distribution target 1400. As can be seen, the shot density varies across the target 1400, with a higher hit density towards the center of the target 1400 (i.e., the aiming point of gun 100) and a decreasing hit density as the distance (R) from the center of the target/shot pattern increases. In addition to determining a shot distribution pattern on the target, a speed of the shot balls of the fired shot shell may be measured using, for example, some type of chronograph.

The process additionally includes determining a shot density per area (shot density/area) as a function of distance (R) from a center of the shot pattern to generate a shot density per area function for the selected choke position of the variable choke (block 1320). The shot distribution target may be divided into multiple different equal areas, with each area having a particular radius from the center of the target, and the shot density (i.e., the number of hits within each area) may be counted to calculate a shot density/area for each area as a function of distance (R) from the center of the target.

Referring again to the shot distribution target 1400 of FIG. 14A, at a particular distance R from the center of the target/shot pattern, a number of shot hits may be counted within multiple different equal areas A 1410-1, 1410-2, 1410-3, etc. at the same distance R from the center of the target/shot pattern, to identify the shot density/area. The number of counted hits per area, across the multiple areas A 1410-1, 1410-2, 1410-3, etc., may be averaged to determine an average shot density per area at distance R. For example, referring to FIG. 14A, a first number of shot hits are counted within an area A 1410-1 at distance $R_1$ from the center of the target/shot pattern, a second number of hits are counted within an area A 1410-2 at the distance $R_1$, and a third number of hits are counted within an area A 1410-3 at the distance $R_1$. The first number, second number and third number of hits are averaged to determine an average shot density at the distance $R_1$.

Figure 14B:
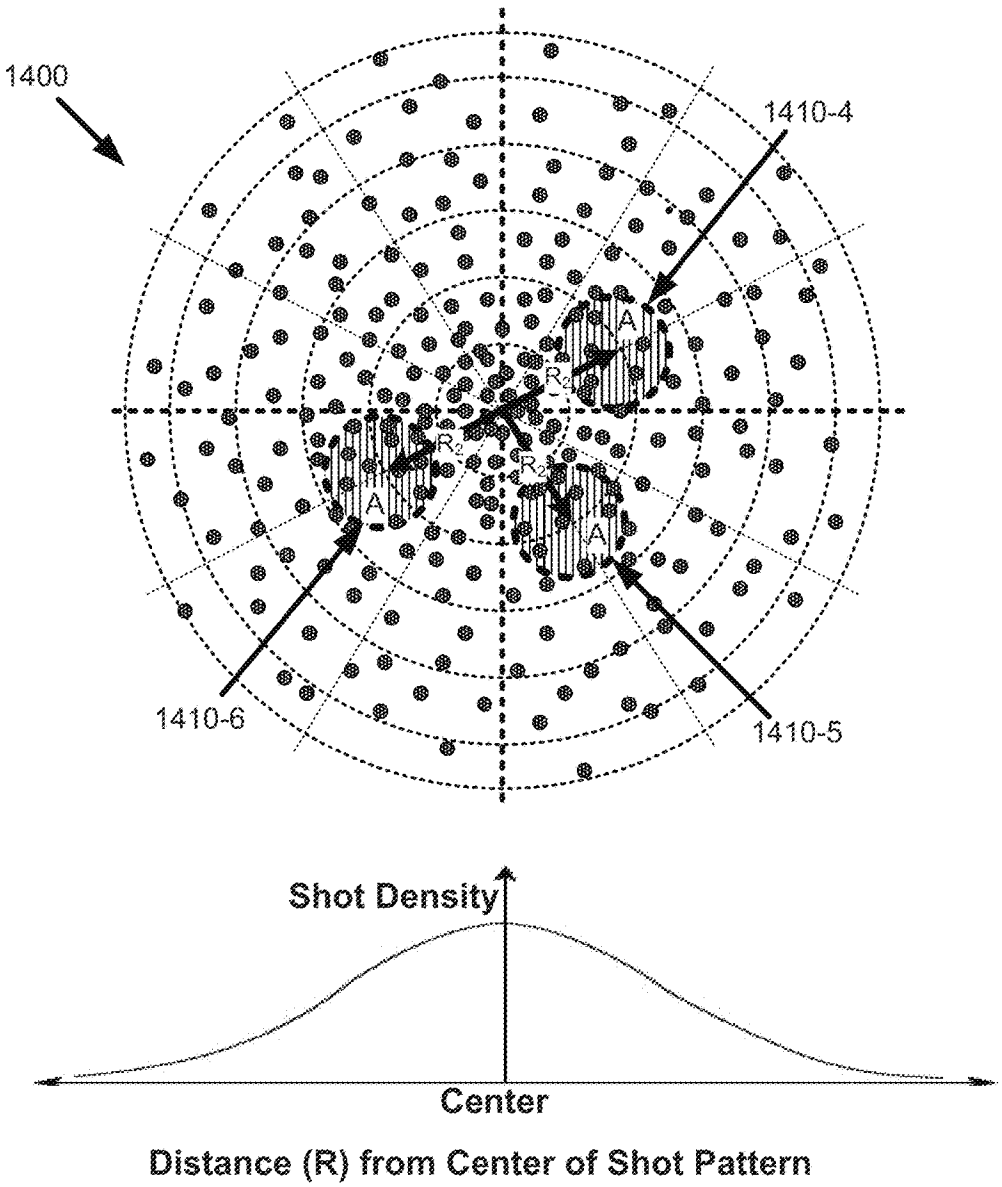

As another example, referring to FIG. 14B, a first number of shot hits are counted within an area A 1410-4 at a distance $R_2$ from the center of the target/shot pattern, a second number of shot hits are counted within an area A 1410-5 at the distance $R_2$, and a third number of shot hits are counted within an area A 1410-6 at the distance $R_2$, where $R_2<R_1$. The first number, second number and third number of hits are averaged to determine an average shot density at the distance $R_2$. Numerous area shot hit measurements may be made at each distance R from the center of the target/shot pattern (e.g., at 12 o'clock, 1 o'clock, 2 o'clock, 3 o'clock, 4 o'clock, etc.) to determine an average shot density at that distance R. The entire shot pattern upon the target 1400 may be measured at numerous different distances R from the center of the target/shot pattern to calculate an average shot density/area as a function of distance R from the center of the target/shot pattern at the particular variable choke position and at the distance (D) of the punt gun 100 from the target 1400. The calculated shot density/area as a function of distance R for the particular shot shell, with the particular size and type of shot balls, is programmed or entered into control system 1020 for use by choke position determination unit 1040.

The process further includes determining, based on the shot density/area function determined in block 1320, a shot cone that corresponds to the shot distribution pattern for the particular shot shell, type of shot, the selected choke constriction position, and the distance D of the punt gun 100 from the target 1400 (block 1330). The outer dimensions of the shot cone for the shot distribution pattern may be determined to be the maximum distance $R_{max}$, from the center of the target/shot pattern, at which the average shot density equals a minimum threshold number of shot hits/area. Therefore, as the choke constriction of the variable choke of punt gun 100 increases, the outer dimensions of the shot cone for the shot distribution pattern shrink (i.e., the cross-sectional area of the shot cone at a particular distance D from the punt gun 100 decreases with increasing choke constriction), and as the choke constriction of the variable choke of punt gun decreases, the outer dimensions of the shot cone for the shot distribution pattern expand (i.e., the cross-sectional area of the shot cone at a particular distance D from the punt gun 100 increases with decreasing choke constriction).

The process further includes adjusting the punt gun 100 variable choke to a selected new choke position (block 1340). Choke position determination unit 1040, based on, for example, external input, determines a new choke position of the variable choke, and sends choke adjustment commands to auto-choke adjustment unit 1045 which, in turn, causes the variable choke mechanism 115 to be mechanically adjusted to the determined choke position. The exemplary process, after selection and adjustment of the new choke position, may return to block 1300 with a repeat of blocks 1300, 1310, 1320, and 1330, to determine a shot density/area function for the selected new choke position of the variable choke of the punt gun 100 at the current distance D of the punt gun 100 from the target 1400.

Blocks 1300-1340 may be selectively repeated, with a known distance of the target from the punt gun 100 being varied, so as to determine the average shot density/area at various target distances from punt gun 100 at particular choke positions of the variable choke of the punt gun 100. The resulting shot density/area measurements, at the various different known target distances, can be used to determine shot distribution patterns that correspond to particular constriction positions of the variable choke, and the size of the shot cones that equate to those shot distribution patterns. Therefore, the various sizes of shot cones, as a function of variable choke position and distance D to the target, may be determined by the shot density/area measurements.

Figure 15:
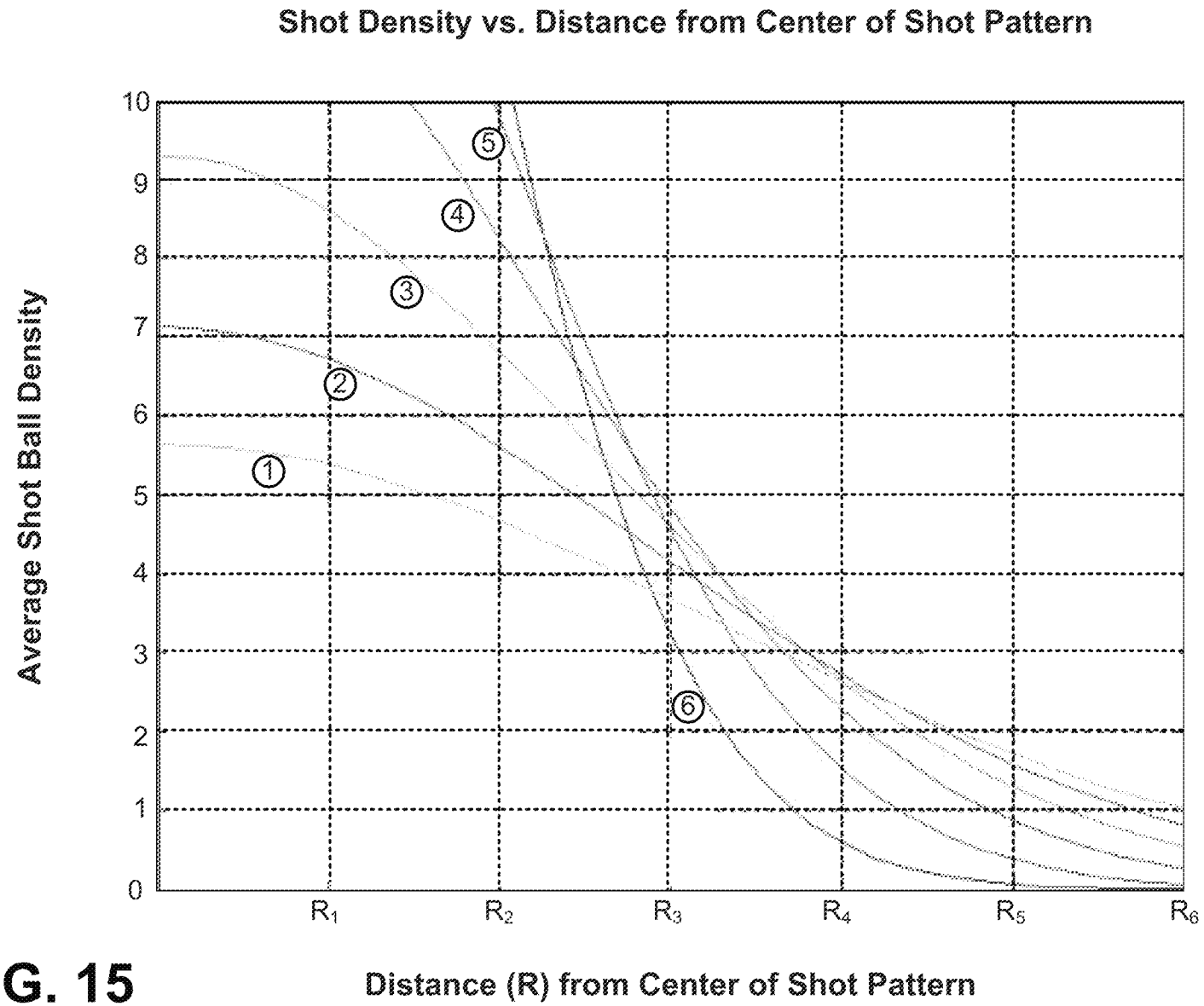
FIG. 15 depicts plots of shot density as a function of distance from the center of a shot pattern for several examples of different choke adjustments for the automated variable choke punt gun.

FIG. 15 depicts an example of plots of shot hit density, as a function of distance R from a center of a shot pattern, for a sequence of choke positions of punt gun 100 at a distance D of punt gun 100 from a target. They axis of FIG. 15 is the average shot ball hit density and the x axis is the distance (R) from the center of the shot pattern. Each curve shown in FIG. 15, identified by successive numbers 1, 2, 3, 4, 5, and 6, represents a different choke position of punt gun 100, with choke position 1 having the least amount of choke constriction and choke position 6 having the most amount of choke constriction, and increasing amounts of choke constriction being applied to punt gun 100 as the choke positions increase from position 1 to position 6. In the example of FIG. 15, at a distance of $R_1$ and at a least constrictive choke position 1, the average shot ball hit density upon the target is calculated to be about 5.5 shot hits/area. Further, in the example of FIG. 15, at the distance of $R_1$ and at the choke position 3, the average shot ball hit density is calculated to be about 8.5 shot hits/area. Additionally, in the example of FIG. 15, at a distance $R_3$ and the choke position 6, the average shot ball hit density is calculated to be about 3.2 shot hits/area.

Figure 16:
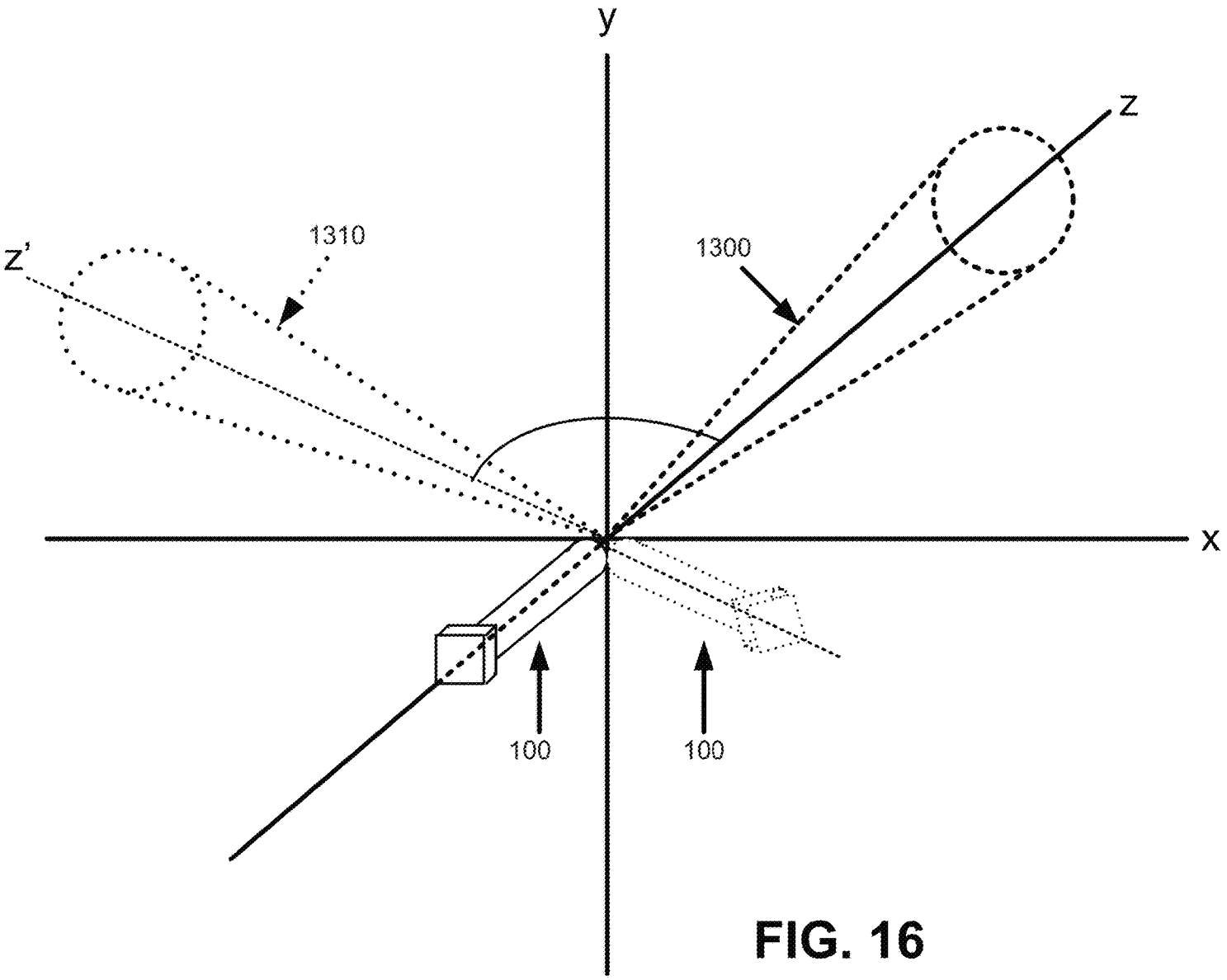
FIG. 16 depicts shot patterns, as fired from the automated variable choke punt gun, in a three-dimensional coordinate system.

FIG. 16 depicts examples of shot cones, as fired from the automatic variable choke punt gun 100, in a three-dimensional coordinate system. In the three-dimensional cartesian coordinate system shown in FIG. 16, the x axis extends left to right from the barrel of punt gun 100, the y axis extends upwards and downwards from the barrel of punt gun 100, and the z axis extends outwards (into the figure) and inwards (out of the figure). Punt gun 100 may alter its aiming point (e.g., as previously shown in FIGS. 8A, 8B, 9A, 9B, and 9C) from a first aiming point that produces a first shot cone 1300, associated with a first shot pattern, to a second aiming point that produces a second shot cone 1310, associated with a second shot pattern. Punt gun 100 may alter its aiming point in the x dimension, the v dimension, and/or the z dimension of the cartesian coordinate system shown in FIG. 16 so as to hit one or more targets. For example, FIG. 16 depicts punt gun 100 having a first aiming point, and a first shot cone 1300, along the z axis. The aiming point of punt gun 100 is then changed to a second aiming point, along an axis z', and having a second shot cone 1310.

Figure 17:
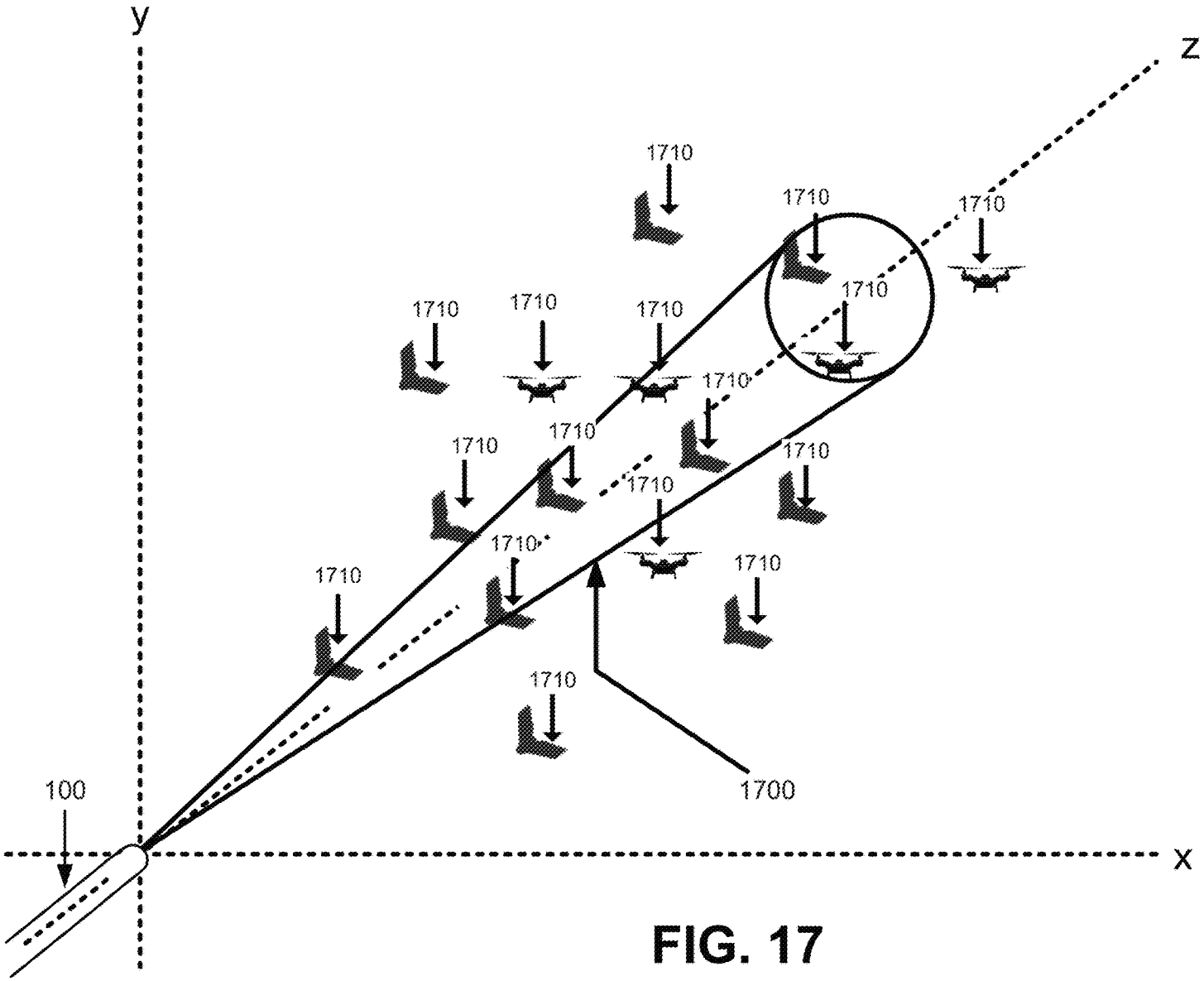
FIG. 17 depicts an example shot cone, and associated shot pattern, associated with a more constricted choke adjustment of the automated variable choke punt gun when targeting multiple flying drones.

FIG. 17 depicts an example of a first shot pattern, fired from the automatic variable choke punt gun 100, with the variable choke set at a constricted choke position. As shown, a swarm of drones 1710, distributed in three-dimensional space, are heading towards punt gun 100, or are located within close proximity to punt gun 100. Control system 1020, in conjunction with target ID system 1015, determines a point of aim, and a first choke position of the variable choke of punt gun 100, for targeting a subset of the swarm of drones 1710. To increase the likelihood of hits on the subset of drones 1710 of the swarm of drones, control system 1020 sets a more constricted choke position such that, when fired, punt gun 100 produces a narrow shot cone 1700, having a more constricted shot pattern, that causes an increased likelihood of one or more hits upon each drone 1710 within the narrow shot cone 1700. The example shot pattern of FIG. 17 may be used when more drones are concentrated in a smaller three-dimensional region, or when an increased likelihood of hits upon drones within the shot cone is desired.

Figure 18:
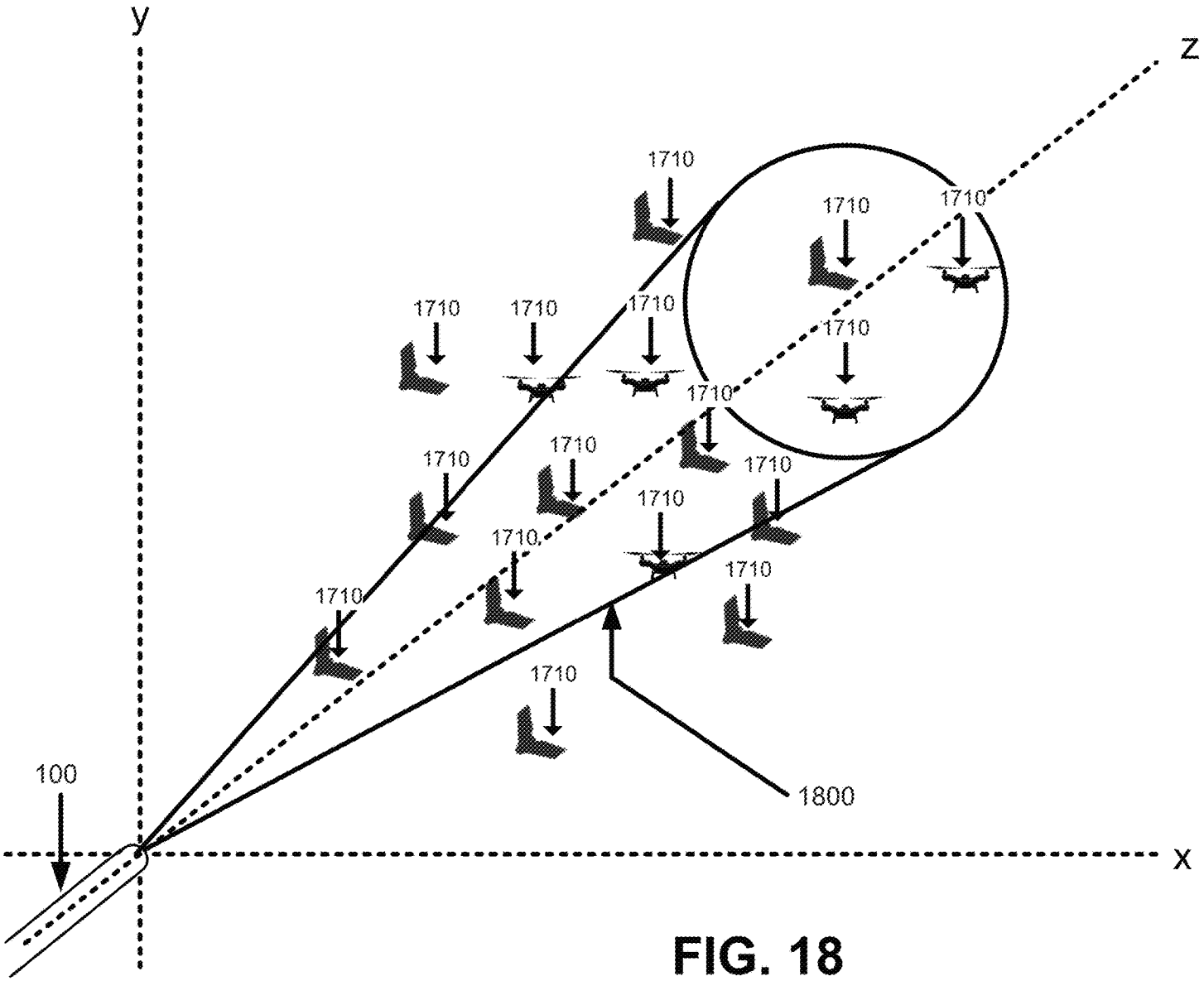
FIG. 18 depicts an example shot cone, and associated shot pattern, associated with a less constricted choke adjustment of the automated variable choke punt gun when targeting multiple flying drones.

FIG. 18 depicts a second shot pattern, fired from automatic variable choke punt gun 100, with the variable choke set at a less constricted choke position. As shown, the swarm of drones 1710, distributed in three-dimensional space, are heading towards punt gun 100, or are located within close proximity to punt gun 100. Control system 1020, in conjunction with target ID system 1015, determines a point of aim, and a second choke position of the variable choke of punt gun 100, for targeting a subset of the swarm of drones 1710. To attempt to hit a greater number of the drones 1710, or if the drones 1710 are distributed over a larger three-dimensional region, control system 1020 sets a less constricted choke position such that, when fired, punt gun 100 produces a wide shot cone 1800, having a less constricted shot pattern relative to the shot pattern shown in FIG. 17, that increases the likelihood of hitting a greater number of drones 1710 (e.g., with at least one shot hit) within the wide shot cone 1800.

Figure 19:
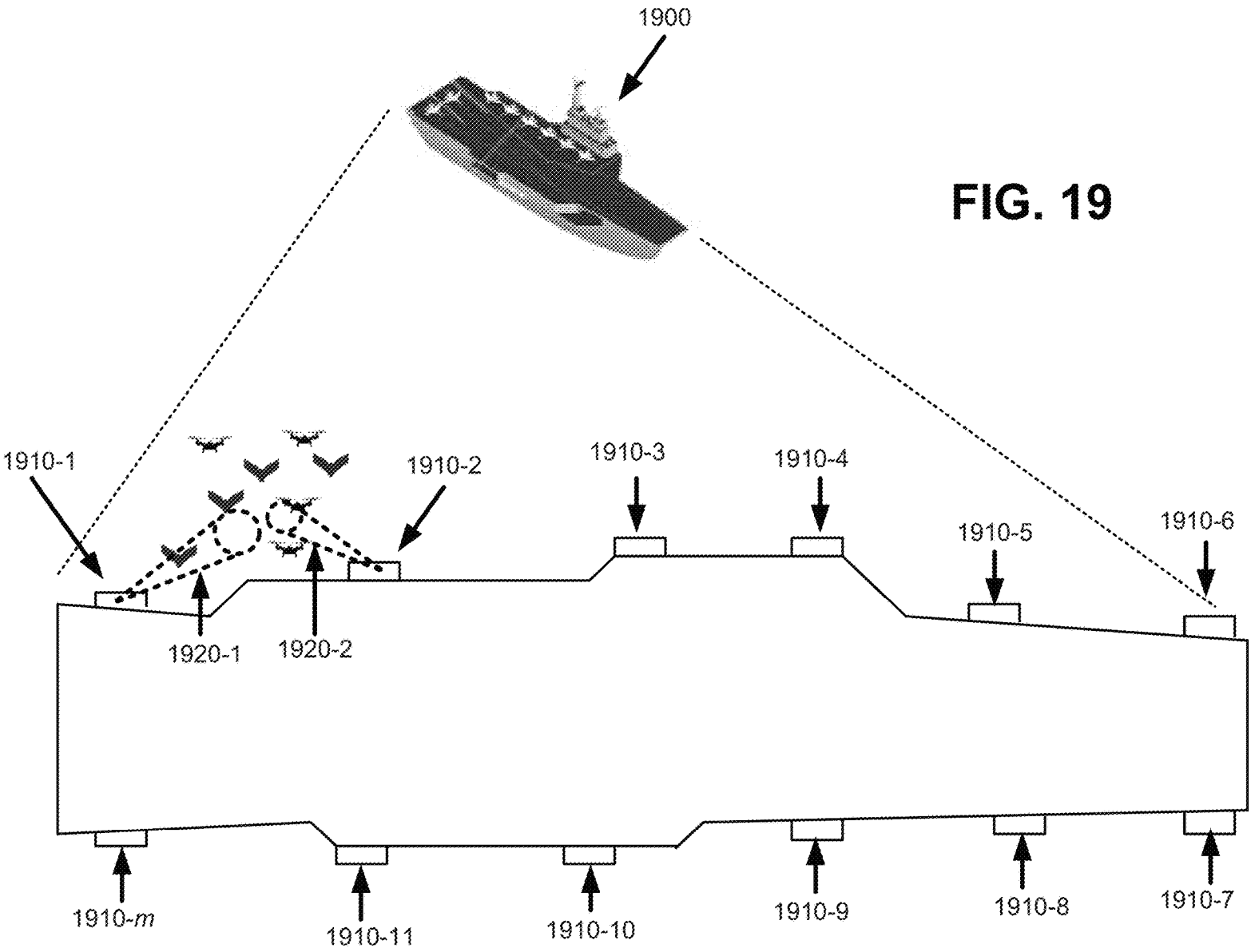
FIG. 19 depicts one example of deployment of an automated variable choke punt gun system upon an aircraft carrier for targeting and destroying flying drones in proximity to the aircraft carrier.

FIG. 19 depicts one example of the use of multiple automatic variable choke punt guns 100 for protecting a naval vessel, such as, for example, an aircraft carrier 1900. As shown, the aircraft carrier 1900 may include multiple gun stations 1910-1 through **1910-*m* (where m is greater than or equal to two) for establishing fields of fire in proximity to the aircraft carrier. A multiple punt gun defense system 600 or 700 (not shown) may be mounted at each gun station 1910 to establish an array of gun defense systems 600 or 700 that serve as a last line of defense against, for example, a swarm of aerial drones attacking the aircraft carrier 1900. In the example depicted in FIG. 19, first gun station 1910-1 and second gun station 1910-2 both mount a punt gun defense system 600 or 700 (not shown). First gun station 1910-1 may fire shot balls in a first shot cone 1920-1 to hit drones in proximity to first gun station 1910-1. Second gun station 1910-2 may fire shot balls in a second shot cone 1920-2 to hit drones in proximity to second gun station 1910-2. The first shot cone 1920-1 of first gun station 1910-1 and the second shot cone 1920-2 of second gun station 1910-2 may intersect with one another so as to provide 100% defensive coverage of the three-dimensional space within a certain proximity to the gun stations 1910-1 and 1910-2 of the aircraft carrier 1900. Therefore, when flying drones attack aircraft carrier 1900, and survive other defensive measures, to come within a certain proximity to aircraft carrier 1900, the punt gun defense systems 600 or 700 mounted at the gun stations 1910** may be brought into action to disable or destroy the attacking drones.

Figure 20:
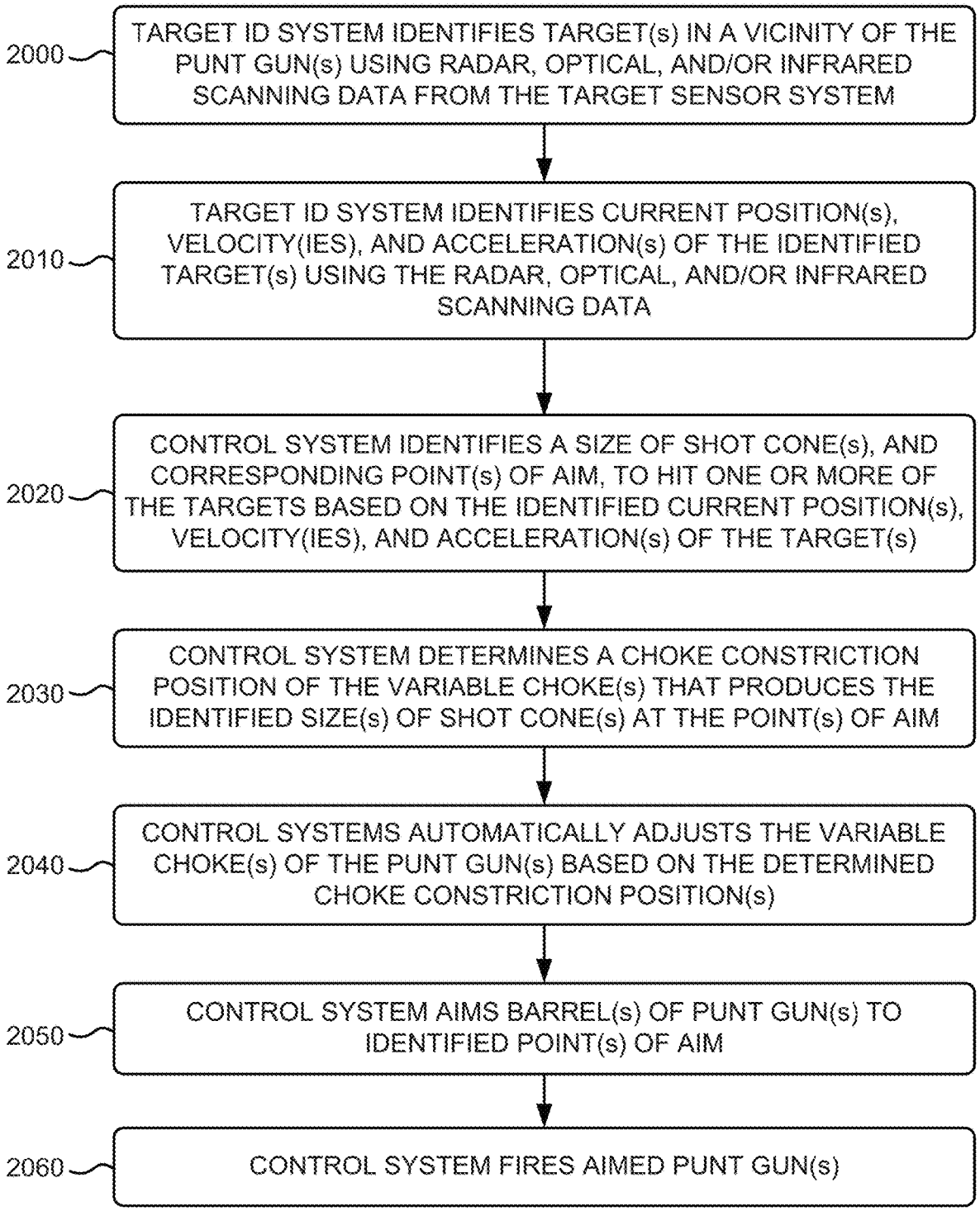
FIG. 20 is a flowchart that illustrates an exemplary process for identifying one or more targets, determining a punt gun point of aim and a variable choke position for optimizing hits upon the one or more targets, and automatically adjusting the variable choke of the punt gun to correspond to the determined choke position.

FIG. 20 is a flowchart that illustrates an exemplary process for identifying one or more targets, determining a punt gun 100 point of aim and a variable choke position for optimizing hits upon the one or more targets, and automatically adjusting the variable choke of the punt gun 100 to correspond to the determined choke position. The exemplary process of FIG. 20 may be implemented by system 1000.

The exemplary process includes target ID system 1015 identifying a target(s) in a vicinity of the punt gun(s) 100 using radar, optical and/or infrared scanning data from the target sensor system 1010 (block 2000). Referring to FIG. 10, radar unit 1025 may generate radio wave scanning data of the vicinity of punt gun(s) 100, optical unit 1030 may generate scanning data in the optical wavelengths of the vicinity of punt gun(s) 100, and infrared unit 1035 may generate scanning data in the infrared wavelengths of the vicinity of punt gun(s) 100. Units 1025, 1030, and/or 1035 supply the scanning data to target ID system 1015 which, in turn, performs one or more algorithms for analyzing the scanning data and identifying the existence of, or characteristics of, a target(s) in the scanning data.

Target ID system 1015 identifies a current position(s), velocity(ies) and acceleration(s) of the identified target(s)

using the radar, optical, and/or infrared scanning data (block 2010). Target ID system 1015 performs one or more algorithms for analyzing the scanning data from units 1025, 1030, and/or 1035 to determine a current position of a target(s), and a movement vector(s) (e.g., velocity direction and magnitude, acceleration direction and magnitude) associated with the target(s), relative to the punt gun(s) 100. The target ID system 1015 may additionally determine a size, shape, and/or cross-sectional area of the identified target(s) using the radar, optical, and/or infrared scanning data.

Control system 1020 identifies a size of a shot cone(s), and a corresponding point(s) of aim, to hit one or more of the identified targets based on the identified current position(s), velocity(ies), and acceleration(s) of the target(s) (block 2020). Based on a position(s) of the one or more targets in three-dimensional space, a known shot ball speed (e.g., measured in block 2020), and possibly a size, shape, and/or cross-sectional area of each of the one or more targets, control system 1020 determines a point of aim of punt gun 100, and a size of a shot cone, that should produce a desired number of shot hits upon each of the one or more identified targets that may, or may not, be moving relative to punt gun 100.

Control system 1020 determines a choke constriction position of the variable choke(s) that produces the identified size(s) of shot cone(s) at the point(s) of aim (block 2030). Using shot distribution pattern data, shot cone data, and shot density/area functions, as determined in the exemplary process of FIG. 13, choke position determination unit 1040 of control system 1020 determines a choke constriction position of the variable choke that produces the size(s) of the shot cone(s) identified in block 2020.

Control system 1020 automatically adjusts the variable choke(s) of punt gun(s) 100 based on the determined choke constriction position (block 2040). Auto-choke adjustment unit 1045 of control system 1020 generates control signals to adjust the choke constriction of the variable choke from its current choke position to the determined choke position that produces the identified size(s) of shot cone(s). For example, if variable choke mechanism 115 includes the components of FIG. 4, auto-choke adjustment unit 1045 generates and sends control signals to motor 420 to cause gear shaft and gear 400 to rotate a certain direction and a certain distance to adjust the choke constriction via rotation of outer choke sleeve 125.

Control system 1020 aims the barrel(s) of the punt gun(s) 100 to the identified point(s) of aim (block 2050). Punt gun aiming and firing unit 1050 of control system 1020 applies control signals to mechanisms that cause the barrel 110 of punt gun 100 to point towards the aiming point determined in block 2020. Control system 1020 fires the aimed punt gun(s) 100 (block 2060). Punt gun aiming and firing unit 1050 applies control signals to mechanisms that cause punt gun 100 to fire the currently chambered shot shell. Subsequent to firing the currently chambered shot shell, reloading mechanisms associated with punt gun 100 automatically eject the spent shot shell, extract a next shot shell from a shell magazine or other type of shell feeding mechanism/structure, and chamber the next shot shell.

The exemplary process of FIG. 20 may be repeated upon each firing and cycling of punt gun(s) 100. Therefore, upon firing of a punt gun 100 in block 2060, automatic ejection of the spent shell, and the reloading and chambering of a next shell, blocks 2000-2060 may be repeated to fire the next shell.

The foregoing description of implementations provides illustration and description, but is not intended to be exhaustive or to limit the invention to the precise form disclosed. Modifications and variations are possible in light of the above teachings or may be acquired from practice of the invention. For example, while series of blocks have been described with respect to FIGS. 13, and 20, the order of the blocks may be varied in other implementations. Moreover, non-dependent blocks may be performed in parallel.

Certain features described above may be implemented as "logic" or a "unit" that performs one or more functions. This logic or unit may include hardware, such as one or more processors, microprocessors, application specific integrated circuits, or field programmable gate arrays, software, or a combination of hardware and software.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise. As used herein, "exemplary" means "serving as an example, instance or illustration."

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

What is claimed is:

1. A system, comprising:

a variable choke coupled to a barrel of a shot gun;

a motor coupled to the variable choke to adjust an amount of choke constriction of the variable choke;

a control system configured to:

determine a desired size of a shot cone of shot to be fired from the shot gun, determine a choke constriction position of the variable choke that produces the determined size of the shot cone, and apply control signals to the motor to cause automatic adjustment of the variable choke bawd on the determined choke constriction position of the variable choke.

2. The system of claim 1, wherein the control system is further configured to:

determine a point of aim of the shot gun, cause the shot gun to be aimed at the determined point of aim, and cause the aimed shot gun to be fired.

3. The system of claim 1, further comprising:

a sensor system configured to obtain scanning data of an environment in a vicinity of the shot gun, wherein the scanning data comprises at least one of radar data, optical data, or infrared data of the environment in the vicinity of the shot gun.

4. The system of claim 3, further comprising:

a target identification unit configured to:

identify one or more targets in the vicinity of the shot gun using the scanning data, and identify at least one of a current position, a velocity, or an acceleration of each of the identified one or more targets using the scanning data.

5. The system of claim 4, wherein the control system is further configured to:

determine the desired size of the shot cone based on the identified at least one of the current position, velocity, or acceleration of each of the identified one or more targets.

6. The system of claim 5, wherein the one or more targets comprise multiple targets and wherein, when identifying the at least one of the current position, velocity, or acceleration of the one or more targets, the target identification unit is further configured to:

identify the at least one of the current position, the velocity, or the acceleration of each of the multiple targets using the scanning data, and wherein, when determining the size of the shot cone, the control system is further configured to:

identify the size of the shot cone, and a corresponding point of aim, to hit the multiple targets based on the identified at least one of the current position, velocity, or acceleration of each of the multiple targets.

7. The system of claim 3, further comprising:

a target identification unit configured to:

identify one or more targets in the vicinity of the shot gun using the scanning data, and identify at least one of a size, shape, or a cross-sectional area of each of the identified one or more targets.

8. The system of claim 7, wherein the control system is further configured to:

determine the desired size of the shot cone based on the identified at least one of the size, shape, or cross-sectional area of each of the identified one or more targets.

9. The system of claim 8, wherein the one or more targets comprise multiple targets and wherein, when identifying the at least one of the size, the shape, or the cross-sectional area of the one or more targets, the target identification unit is further configured to:

identify the at least one of the size, the shape, or the cross-sectional area of each of the multiple targets using the scanning data, and wherein, when determining the size of the shot cone, the control system is further configured to:

identify the size of the shot cone, and a corresponding point of aim, to hit the multiple targets based on the identified at least one of the size, the shape, or the cross-sectional area of each of the multiple targets.

10. The system of claim 1, wherein the shot gun comprises a punt gun.

11. The system of claim 1, wherein, when applying the control signals to the motor, the control system is further configured to:

apply the control signals to the motor to cause the motor to increase or decrease constriction of the variable choke of the shot gun to the determined choke constriction position.

12. The system of claim 1, further comprising:

a sensor system configured to obtain scanning data of an environment in a vicinity of the shot gun; and a target identification unit configured to:

identify one or more targets within range of the shot gun using the scanning data, and identify at least one of a current position, a velocity, an acceleration, a size, a shape, or a cross-sectional area of each of the identified one or more targets, wherein the control system is further configured to:

determine a point of aim of the shot gun based on the identified at least one of the current position, velocity, acceleration, size, shape, or cross-sectional area of each of the identified one or more targets, and determine the desired size of the shot cone, based on the identified at least one of the current position, velocity, acceleration, size, shape, or cross-sectional area of each of the identified one or more targets and the determined point of aim of the shot gun, that should produce a certain number of shot hits upon each of the identified one or more targets.

13. A system, comprising:

a variable choke coupled to a barrel of a shot gun;

an adjustment mechanism for adjusting the variable choke;

a sensor system configured to obtain scanning data of an environment in a vicinity of the shot gun;

a target identification unit configured to:

identify one or more targets in the vicinity of the shot gun using the scanning data, and identify at least one of a current position, a velocity, an acceleration, a size, a shape, or a cross-sectional area of each of the identified one or more targets using the scanning data; and a control system configured to:

determine a size of a shot cone based on the identified at least one of the current position, velocity, acceleration, size, shape, or cross-sectional area of each of the identified one or more targets, determine a choke constriction position of the variable choke that produces the determined size of the shot cone, and control the adjustment mechanism to automatically adjust the variable choke to the determined choke constriction position.

14. The system of claim 13, wherein the control system is further configured to:

determine a point of aim of the shot gun based on the identified at least one of the current position, velocity, acceleration, size, shape, or cross-sectional area of each of the identified one or more targets, cause the shot gun to be aimed at the determined point of aim, and cause the aimed shot gun to be fired.

15. The system of claim 13, wherein the identified one or more targets comprises multiple targets, and wherein the target identification unit is configured to identify at least one of the current position, velocity, acceleration, size, shape, or cross-sectional area of each of the identified multiple targets using the scanning data; and wherein the control system is further configured to determine the size of the shot cone based on the identified at least one of the current position, velocity, acceleration, size, shape, or cross-sectional area of each of the multiple targets.

16. The system of claim 13, wherein the shot gun comprises a punt gun.

17. The system of claim 13, wherein the sensor system comprises at least one of a radar unit, an optical unit, or an infrared unit.

18. The system of claim 17, wherein the scanning data comprises at least one of radar data, optical data, or infrared data of the environment in the vicinity of the shot gun.

19. The system of claim 13, wherein the control system is further configured to:

determine a point of aim of the shot gun based on the identified at least one of the current position, velocity, acceleration, size, shape, or cross-sectional area of each of the identified one or more targets, and determine the size of the shot cone, based on the identified at least one of the current position, velocity, acceleration, size, shape, or cross-sectional area of each of the identified one or more target and the determined point of aim of the shot gun, that should produce a certain number of shot hits upon each of the identified one or more targets.

* * * * *